US009489919B2

(12) United States Patent
Wang et al.

(10) Patent No.: US 9,489,919 B2
(45) Date of Patent: Nov. 8, 2016

(54) SYSTEM AND METHOD FOR PRIMARY-MATCHED COLOR GAMUT MAPPING

(71) Applicant: QUALCOMM MEMS Technologies, Inc., San Diego, CA (US)

(72) Inventors: Shen-Ge Wang, Milpitas, CA (US); Songhe Cai, San Diego, CA (US); Jian Jim Ma, San Diego, CA (US)

(73) Assignee: QUALCOMM MEMS Technologies, Inc., San Diego, CA (US)

( * ) Notice: Subject to any disclaimer, the term of this patent is extended or adjusted under 35 U.S.C. 154(b) by 94 days.

(21) Appl. No.: 14/597,982

(22) Filed: Jan. 15, 2015

(65) Prior Publication Data

US 2016/0210935 A1 Jul. 21, 2016

(51) Int. Cl.
*G09G 5/02* (2006.01)
*G09G 5/06* (2006.01)

(52) U.S. Cl.
CPC ..... *G09G 5/06* (2013.01); *G09G 2320/0666* (2013.01); *G09G 2340/06* (2013.01)

(58) Field of Classification Search
None
See application file for complete search history.

(56) References Cited

U.S. PATENT DOCUMENTS

| | | | | |
|---|---|---|---|---|
| 6,734,851 | B2 | 5/2004 | Georgiev | |
| 8,786,626 | B2 | 7/2014 | Kishimoto | |
| 2013/0135364 | A1* | 5/2013 | Govil | G09G 5/10 345/690 |
| 2014/0225910 | A1 | 8/2014 | Zeng et al. | |
| 2014/0225912 | A1* | 8/2014 | Govil | G09G 3/3466 345/593 |
| 2015/0109355 | A1* | 4/2015 | Wang | G09G 3/2051 345/691 |

* cited by examiner

*Primary Examiner* — Joseph Haley
*Assistant Examiner* — Ifedayo Iluyomade
(74) *Attorney, Agent, or Firm* — Knobbe Martens Olson & Bear LLP

(57) ABSTRACT

This disclosure provides systems, methods and apparatus, including computer programs encoded on computer storage media, to map color of an input image pixel to a corresponding device element of a display device capable of displaying a plurality of device primary colors associated with the display element. The color mapping method includes dividing the display color gamut associated with the display device into a plurality of segments including a plurality of display colors. The input color gamut is also divided into a plurality of segments corresponding to the plurality of segments of the display color gamut. The color mapping further includes identifying a segment of the input color gamut including the image pixel color; determining a corresponding segment of the display color gamut; and assigning a display color that is a weighted combination of the colors included in the determined segment of the display color gamut.

18 Claims, 12 Drawing Sheets

| Segment Voltages | Common Voltages | | | | |
|---|---|---|---|---|---|
| | $VC_{ADD_H}$ | $VC_{HOLD_H}$ | $VC_{REL}$ | $VC_{HOLD_L}$ | $VC_{ADD_L}$ |
| $VS_H$ | Stable | Stable | Relax | Stable | Actuate |
| $VS_L$ | Actuate | Stable | Relax | Stable | Stable |

SYSTEM AND METHOD FOR PRIMARY-MATCHED COLOR GAMUT MAPPING

TECHNICAL FIELD

This disclosure relates to methods and systems for mapping input colors of an image to colors within a device-defined color gamut of a display device.

DESCRIPTION OF THE RELATED TECHNOLOGY

Electromechanical systems (EMS) include devices having electrical and mechanical elements, actuators, transducers, sensors, optical components such as mirrors and optical films, and electronics. EMS devices or elements can be manufactured at a variety of scales including, but not limited to, microscales and nanoscales. For example, microelectromechanical systems (MEMS) devices can include structures having sizes ranging from about a micron to hundreds of microns or more. Nanoelectromechanical systems (NEMS) devices can include structures having sizes smaller than a micron including, for example, sizes smaller than several hundred nanometers. Electromechanical elements may be created using deposition, etching, lithography, and/or other micromachining processes that etch away parts of substrates and/or deposited material layers, or that add layers to form electrical and electromechanical devices.

One type of EMS device is called an interferometric modulator (IMOD). The term IMOD or interferometric light modulator refers to a device that selectively absorbs and/or reflects light using the principles of optical interference. In some implementations, an IMOD display element may include a pair of conductive plates, one or both of which may be transparent and/or reflective, wholly or in part, and capable of relative motion upon application of an appropriate electrical signal. For example, one plate may include a stationary layer deposited over, on or supported by a substrate and the other plate may include a reflective membrane separated from the stationary layer by an air gap. The position of one plate in relation to another can change the optical interference of light incident on the IMOD display element. IMOD-based display devices have a wide range of applications, and are anticipated to be used in improving existing products and creating new products, especially those with display capabilities.

Some display devices, such as, for example EMS systems based display devices, can produce colors by utilizing more than three primary colors. Each of the primary colors can have reflectance or transmittance characteristics that are independent of each other. Such devices can be referred to as multi-primary display devices. In multi-primary display devices there may be more than one combination of the multiple primary colors to produce the same color having same input color values, such as red (R), green (G), and blue (B) values.

SUMMARY

The systems, methods and devices of this disclosure each have several innovative aspects, no single one of which is solely responsible for the desirable attributes disclosed herein.

One innovative aspect of the subject matter described in this disclosure is implemented in an apparatus comprising a display device including a reflective display element capable of displaying N device primary colors associated with a display color gamut divided into N-2 segments and a computing device capable of communicating with the display device. The number of the N primary colors can be greater than or equal to six. The number of the N primary colors can be less than 256. The number of segments of the display color gamut can be at least four. The computing device is capable of processing image data including a plurality of image pixels with each image pixel associated with an input image pixel color represented as a combination of different input primary colors associated with an input color gamut. The input color gamut is divided into N-2 segments. Each of the N-2 segments of the display color gamut corresponds to one of the N-2 segments of the input color gamut. The input image pixel color can be represented in the standard CIE XYZ color space or a color space that is a linear transformation of the CIE XYZ color space.

For a given image pixel, the computing device is further capable of determining a tetrahedral segment of the input color gamut that includes the input image pixel color and determining a corresponding tetrahedral segment of the display color gamut, the display color gamut. The tetrahedral segment of the input color gamut includes a first set of image colors and the tetrahedral segment of the display color gamut includes a second set of device primary colors selected from the N device primary colors. At least two image colors of the first set are perceptually similar to two corresponding device primary colors of the second set. The computing device is further capable of calculating weights for a linear combination of the first set of image color such that the input image pixel color is a weighted combination of the first set of image colors. The computing device is additionally capable of determining a display color by applying the calculated weights to the second set of device primary colors and assigning the display color to a display element of the display device that corresponds to the image pixel. The determined display color is a weighted combination of the second set of device primary colors.

In various implementations of the apparatus the first set of image colors can include a black input primary color, a white input primary color, a first non-white and non-black color, and a second non-white and non-black color, wherein the first and second non-white and non-black colors can be a combination of one or more input primary colors.

In various implementations of the apparatus the second set of device primary colors can include a black device primary color, a white device primary color, a first non-white and non-black device primary color and a second non-white and non-black device primary color, wherein the first and second non-white and non-black device primary colors can be selected from the N device primary colors. The first non-white and non-black device primary color can be perceptually similar to the first non-white and non-black color of the corresponding tetrahedral segment of the input color gamut. The second non-white and non-black device primary color can be perceptually similar to the second non-white and non-black color of the corresponding tetrahedral segment of the input color gamut.

In various implementations, the display device can be a reflective display device. At least some of the plurality of display elements can include a movable mirror. Each of the N primary colors can correspond to a distinct position of the movable mirror. Various implementations of the apparatus can include a driver circuit capable of sending at least one signal to the display device. Various implementations of the apparatus can include a controller capable of sending at least a portion of the image data to the driver circuit. Various implementations of the apparatus can include an image source module capable of sending the image data to the processor. The image source module can include at least one of a receiver, transceiver, and transmitter. Various implementations of the apparatus can include an input device capable of receiving input data and to communicate the input data to the processor.

Another innovative aspect of the subject matter disclosed in this application can be implemented in a computer-implemented method to display image data on a display device including a reflective display element capable of displaying N device primary colors associated with a display color gamut divided into N-2 segments. A number of the N primary colors can be greater than or equal to six and/or less than 256. A number of segments of the display color gamut can be at least four. The image data includes a plurality of image pixels with each image pixel associated with an input image pixel color represented as a combination of different input primary colors associated with an input color gamut. The input color gamut is divided into N-2 segments. Each of the N-2 segments of the display color gamut corresponds to one of the N-2 segments of the input color gamut.

For a given image pixel, the method comprises determining a tetrahedral segment of the input color gamut that includes the input image pixel color and determining a corresponding tetrahedral segment of the display color gamut. The tetrahedral segment of the input color gamut includes a first set of image colors and the display color gamut tetrahedral segment includes a second set of device primary colors selected from the N device primary colors. At least two image colors of the first set are perceptually similar to two corresponding device primary colors of the second set. The method further comprises calculating weights for a linear combination of the first set of image color such that the input image pixel color is a weighted combination of the first set of image colors. The method further comprises determining a display color by applying the calculated weights to the second set of device primary colors and assigning the display color to a display element of the display device that corresponds to the image pixel. The display color is a weighted combination of the second set of device primary colors. The method is performed under control of a hardware computing device associated with the display device.

Yet another innovative aspect of the subject matter disclosed in this application can be implemented in a non-transitory computer storage medium comprising instructions that when executed by a processor cause the processor to perform a method to display image data on a display device including a reflective display element capable of displaying N device primary colors associated with a display color gamut divided into N-2 segments. A number of the N primary colors can be greater than or equal to six and/or less than 256. A number of segments of the display color gamut can be at least four. The image data includes a plurality of image pixels with each image pixel associated with an input image pixel color represented as a combination of different input primary colors associated with an input color gamut. The input color gamut is divided into N-2 segments. Each of the N-2 segments of the display color gamut corresponds to one of the N-2 segments of the input color gamut.

For a given image pixel, the method comprises determining a tetrahedral segment of the input color gamut that includes the input image pixel color and determining a corresponding tetrahedral segment of the display color gamut. The tetrahedral segment of the input color gamut includes a first set of image colors and the display color gamut tetrahedral segment includes a second set of device primary colors selected from the N device primary colors. At least two image colors of the first set are perceptually similar to two corresponding device primary colors of the second set. The method further comprises calculating weights for a linear combination of the first set of image color such that the input image pixel color is a weighted combination of the first set of image colors. The method further comprises determining a display color by applying the calculated weights to the second set of device primary colors and assigning the display color to a display element of the display device that corresponds to the image pixel. The display color is a weighted combination of the second set of device primary colors. The method is performed under control of a hardware computing device associated with the display device.

Details of one or more implementations of the subject matter described in this disclosure are set forth in the accompanying drawings and the description below. Although the examples provided in this disclosure are primarily described in terms of EMS and MEMS-based displays the concepts provided herein may apply to other types of displays such as liquid crystal displays, organic light-emitting diode ("OLED") displays, and field emission displays. Other features, aspects, and advantages will become apparent from the description, the drawings and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

Figure 1:
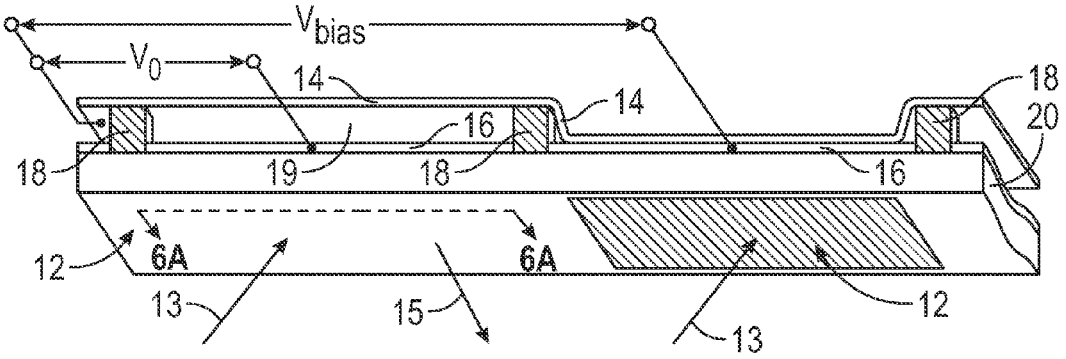
FIG. 1 is an isometric view illustration depicting two adjacent interferometric modulator (IMOD) display elements in a series or array of display elements of an IMOD display device.

The following description is directed to certain implementations for the purposes of describing the innovative aspects of this disclosure. However, a person having ordinary skill in the art will readily recognize that the teachings herein can be applied in a multitude of different ways. The described implementations may be implemented in any device, apparatus, or system that can be configured to display an image, whether in motion (such as video) or stationary (such as still images), and whether textual, graphical or pictorial. More particularly, it is contemplated that the described implementations may be included in or associated with a variety of electronic devices such as, but not limited to: mobile telephones, multimedia Internet enabled cellular telephones, mobile television receivers, wireless devices, smartphones, Bluetooth® devices, personal data assistants (PDAs), wireless electronic mail receivers, hand-held or portable computers, netbooks, notebooks, smartbooks, tablets, printers, copiers, scanners, facsimile devices, global positioning system (GPS) receivers/navigators, cameras, digital media players (such as MP3 players), camcorders, game consoles, wrist watches, clocks, calculators, television monitors, flat panel displays, electronic reading devices (e.g., e-readers), computer monitors, auto displays (including odometer and speedometer displays, etc.), cockpit controls and/or displays, camera view displays (such as the display of a rear view camera in a vehicle), electronic photographs, electronic billboards or signs, projectors, architectural structures, microwaves, refrigerators, stereo systems, cassette recorders or players, DVD players, CD players, VCRs, radios, portable memory chips, washers, dryers, washer/dryers, parking meters, packaging (such as in electromechanical systems (EMS) applications including microelectromechanical systems (MEMS) applications, as well as non-EMS applications), aesthetic structures (such as display of images on a piece of jewelry or clothing) and a variety of EMS devices. The teachings herein also can be used in non-display applications such as, but not limited to, electronic switching devices, radio frequency filters, sensors, accelerometers, gyroscopes, motion-sensing devices, magnetometers, inertial components for consumer electronics, parts of consumer electronics products, varactors, liquid crystal devices, electrophoretic devices, drive schemes, manufacturing processes and electronic test equipment. Thus, the teachings are not intended to be limited to the implementations depicted solely in the Figures, but instead have wide applicability as will be readily apparent to one having ordinary skill in the art.

The systems and methods described herein can be used to display high bit-depth color images (e.g., images having 8 bits per color channel) on a display device including a plurality of display elements having lower color bit-depth (for example, 1, 2 or 4 bits per color channel). Each display element of the display device can produce multiple primary colors (for example, greater than four (4) or six (6)) in a color gamut associated with the display device. To display high bit-depth color images (for example, RGB images with 8 bits per color channel or 256 color levels per color channel) on a multi-primary display device, temporal modulation/dithering and/or spatial dithering can be used. For example, using temporal modulation with four temporal frames and black and white colors, five colors including three gray levels can be displayed. As another example, using temporal dithering with two temporal frames and four primary colors, six colors by different two-primary combinations can be displayed. Many different colors can be produced by including more primary colors and temporal frames.

Systems and methods described herein can be used for rendering static images as well as videos. The systems and methods described herein can be used to display an image including a plurality of input colors onto a multi-primary display device by mapping the input colors to colors within the color gamut defined by the primary colors of the display device and their combinations. The color gamut associated with the display device can be divided into a plurality of tetrahedral segments. The corners of each tetrahedral segment in the display device color gamut are formed by a first set of colors in the display color space. For example, the first set of colors can include a black device primary color, a white device primary color and two non-white and non-black device primary colors selected from the plurality of primary colors produced by the multi-primary display device. Corresponding to each tetrahedral segment of the display device color gamut is a tetrahedral segment of the input image color gamut. The corners of each tetrahedral segment of the input image color gamut include a second set of colors in the image color space at least some of which are perceptually similar to some of the colors from the first set. For example, in various implementations, the second set can include a black input primary color, a white input primary color and two non-white and non-black input colors selected from the primary colors of the input image color gamut and/or their combinations that are perceptually similar to the two non-white and non-black device primary colors of the corresponding tetrahedral segment of the display device color gamut.

The color of each image pixel of the image is mapped onto a corresponding display element of the display device by identifying the tetrahedral segment of the input color gamut including the color of the image pixel; determining a tetrahedral segment of the display device color gamut that corresponds to the identified tetrahedral segment; determining the corresponding display color by calculating a weighted combination of the black device primary color, the white device primary color and the two non-white and non-black device primary colors; and assigning the determined color to the display element.

Particular implementations of the subject matter described in this disclosure can be implemented to realize one or more of the following potential advantages. The color mapping methods described herein can be used to display images on multi-primary display devices that can generate colors which can be expressed as a linear combination of primary colors in a standard color space (e.g., International Commission on Illumination (CIE) XYZ color space). Most colors describing input images for display are defined in a three-dimensional RGB color space (e.g., a standard sRGB color space) with RGB values specified in a fixed range (e.g., represented by 8 bits, or 0-255). Accordingly, the input color gamut can be specified by a cube or eight input color primaries which are the eight vertices of the cube-shape input color gamut and can be named as white (W), black (K), red (R), green (G), blue (B), cyan (C), magenta (M) and yellow (Y), respectively. The color mapping methods described herein divide the input color gamut into six tetrahedral segments, WRYK, WYGK, WGCK, WCBK, WBMK and WMRK. By selecting eight device-defined color primaries to match the eight input color primaries, the described color mapping methods can map all input colors within the input color gamut into colors within the device color gamut as linear combinations of the device color primaries. Each of the combinations is a weighted linear combination of four primaries defining the corresponding tetrahedron of the color gamut. By mapping device white primary to input white primary, device black primary to input black primary, and matching color hues of other device color primaries and corresponding input color primaries the color mapping methods described herein can avoid the out-of-gamut mapping issue and provide smooth color transition of mapped colors while minimizing perceived color distortion. By using more color hue matched primaries and further dividing the six segments described above into more tetrahedral segments, the color distortion due to color mapping can be further reduced. The four weights of a linear primary combination in the color mapping described can be determined by the RGB values of the input color, independent of the particular color definitions of the four device color primaries. Accordingly, the color mapping method described herein reduces the computation complexity as compared to other mapping methods. Moreover, since the calculated weights are directly associated with parameters used in image rendering methods following the color mapping in the image processing pipeline for the display device, such as temporal dithering methods, vector screening methods and error diffusion methods, the computations required to implement such image rendering can be largely simplified by using the color mapping method described herein. Furthermore, the color mapping method described herein can reduce the size of look-up tables used in the other mapping process thereby reducing the memory requirement.

An example of a suitable EMS or MEMS device or apparatus, to which the described implementations may apply, is a reflective display device. Reflective display devices can incorporate interferometric modulator (IMOD) display elements that can be implemented to selectively absorb and/or reflect light incident thereon using principles of optical interference. IMOD display elements can include a partial optical absorber, a reflector that is movable with respect to the absorber, and an optical resonant cavity defined between the absorber and the reflector. In some implementations, the reflector can be moved to two or more different positions, which can change the size of the optical resonant cavity and thereby affect the reflectance of the IMOD. The reflectance spectra of IMOD display elements can create fairly broad spectral bands that can be shifted across the visible wavelengths to generate different colors. The position of the spectral band can be adjusted by changing the thickness of the optical resonant cavity. One way of changing the optical resonant cavity is by changing the position of the reflector with respect to the absorber.

FIG. 1 is an isometric view illustration depicting two adjacent interferometric modulator (IMOD) display elements in a series or array of display elements of an IMOD display device. The IMOD display device includes one or more interferometric EMS, such as MEMS, display elements. In these devices, the interferometric MEMS display elements can be configured in either a bright or dark state. In the bright ("relaxed," "open" or "on," etc.) state, the display element reflects a large portion of incident visible light. Conversely, in the dark ("actuated," "closed" or "off," etc.) state, the display element reflects little incident visible light. MEMS display elements can be configured to reflect predominantly at particular wavelengths of light allowing for a color display in addition to black and white. In some implementations, by using multiple display elements, different intensities of color primaries and shades of gray can be achieved.

The IMOD display device can include an array of IMOD display elements which may be arranged in rows and columns. Each display element in the array can include at least a pair of reflective and semi-reflective layers, such as a movable reflective layer (i.e., a movable layer, also referred to as a mechanical layer) and a fixed partially reflective layer (i.e., a stationary layer), positioned at a variable and controllable distance from each other to form an air gap (also referred to as an optical gap, cavity or optical resonant cavity). The movable reflective layer may be moved between at least two positions. For example, in a first position, i.e., a relaxed position, the movable reflective layer can be positioned at a distance from the fixed partially reflective layer. In a second position, i.e., an actuated position, the movable reflective layer can be positioned more closely to the partially reflective layer. Incident light that reflects from the two layers can interfere constructively and/or destructively depending on the position of the movable reflective layer and the wavelength(s) of the incident light, producing either an overall reflective or non-reflective state for each display element. In some implementations, the display element may be in a reflective state when unactuated, reflecting light within the visible spectrum, and may be in a dark state when actuated, absorbing and/or destructively interfering light within the visible range. In some other implementations, however, an IMOD display element may be in a dark state when unactuated, and in a reflective state when actuated. In some implementations, the introduction of an applied voltage can drive the display elements to change states. In some other implementations, an applied charge can drive the display elements to change states.

The depicted portion of the array in FIG. 1 includes two adjacent interferometric MEMS display elements in the form of IMOD display elements 12. In the display element 12 on the right (as illustrated), the movable reflective layer 14 is illustrated in an actuated position near, adjacent or touching the optical stack 16. The voltage $V_{bias}$ applied across the display element 12 on the right is sufficient to move and also maintain the movable reflective layer 14 in the actuated position. In the display element 12 on the left (as illustrated), a movable reflective layer 14 is illustrated in a relaxed position at a distance (which may be predetermined based on design parameters) from an optical stack 16, which includes a partially reflective layer. The voltage $V_0$ applied across the display element 12 on the left is insufficient to cause actuation of the movable reflective layer 14 to an actuated position such as that of the display element 12 on the right.

In FIG. 1, the reflective properties of IMOD display elements 12 are generally illustrated with arrows indicating light 13 incident upon the IMOD display elements 12, and light 15 reflecting from the display element 12 on the left. Most of the light 13 incident upon the display elements 12 may be transmitted through the transparent substrate 20, toward the optical stack 16. A portion of the light incident upon the optical stack 16 may be transmitted through the partially reflective layer of the optical stack 16, and a portion will be reflected back through the transparent substrate 20. The portion of light 13 that is transmitted through the optical stack 16 may be reflected from the movable reflective layer 14, back toward (and through) the transparent substrate 20. Interference (constructive and/or destructive) between the light reflected from the partially reflective layer of the optical stack 16 and the light reflected from the movable reflective layer 14 will determine in part the intensity of wavelength(s) of light 15 reflected from the display element 12 on the viewing or substrate side of the device. In some implementations, the transparent substrate 20 can be a glass substrate (sometimes referred to as a glass plate or panel). The glass substrate may be or include, for example, a borosilicate glass, a soda lime glass, quartz, Pyrex, or other suitable glass material. In some implementations, the glass substrate may have a thickness of 0.3, 0.5 or 0.7 millimeters, although in some implementations the glass substrate can be thicker (such as tens of millimeters) or thinner (such as less than 0.3 millimeters). In some implementations, a non-glass substrate can be used, such as a polycarbonate, acrylic, polyethylene terephthalate (PET) or polyether ether ketone (PEEK) substrate. In such an implementation, the non-glass substrate will likely have a thickness of less than 0.7 millimeters, although the substrate may be thicker depending on the design considerations. In some implementations, a non-transparent substrate, such as a metal foil or stainless steel-based substrate can be used. For example, a reverse-IMOD-based display, which includes a fixed reflective layer and a movable layer which is partially transmissive and partially reflective, may be configured to be viewed from the opposite side of a substrate as the display elements 12 of FIG. 1 and may be supported by a non-transparent substrate.

The optical stack 16 can include a single layer or several layers. The layer(s) can include one or more of an electrode layer, a partially reflective and partially transmissive layer, and a transparent dielectric layer. In some implementations, the optical stack 16 is electrically conductive, partially transparent and partially reflective, and may be fabricated, for example, by depositing one or more of the above layers onto a transparent substrate 20. The electrode layer can be formed from a variety of materials, such as various metals, for example indium tin oxide (ITO). The partially reflective layer can be formed from a variety of materials that are partially reflective, such as various metals (e.g., chromium and/or molybdenum), semiconductors, and dielectrics. The partially reflective layer can be formed of one or more layers of materials, and each of the layers can be formed of a single material or a combination of materials. In some implementations, certain portions of the optical stack 16 can include a single semi-transparent thickness of metal or semiconductor which serves as both a partial optical absorber and electrical conductor, while different, electrically more conductive layers or portions (e.g., of the optical stack 16 or of other structures of the display element) can serve to bus signals between IMOD display elements. The optical stack 16 also can include one or more insulating or dielectric layers covering one or more conductive layers or an electrically conductive/partially absorptive layer.

In some implementations, at least some of the layer(s) of the optical stack 16 can be patterned into parallel strips, and may form row electrodes in a display device as described further below. As will be understood by one having ordinary skill in the art, the term "patterned" is used herein to refer to masking as well as etching processes. In some implementations, a highly conductive and reflective material, such as aluminum (Al), may be used for the movable reflective layer 14, and these strips may form column electrodes in a display device. The movable reflective layer 14 may be formed as a series of parallel strips of a deposited metal layer or layers (orthogonal to the row electrodes of the optical stack 16) to form columns deposited on top of supports, such as the illustrated posts 18, and an intervening sacrificial material located between the posts 18. When the sacrificial material is etched away, a defined gap 19, or optical cavity, can be formed between the movable reflective layer 14 and the optical stack 16. In some implementations, the spacing between posts 18 may be approximately 1-1000 μm, while the gap 19 may be approximately less than 10,000 Angstroms (Å).

In some implementations, each IMOD display element, whether in the actuated or relaxed state, can be considered as a capacitor formed by the fixed and moving reflective layers. When no voltage is applied, the movable reflective layer 14 remains in a mechanically relaxed state, as illustrated by the display element 12 on the left in FIG. 1, with the gap 19 between the movable reflective layer 14 and optical stack 16. However, when a potential difference, i.e., a voltage, is applied to at least one of a selected row and column, the capacitor formed at the intersection of the row and column electrodes at the corresponding display element becomes charged, and electrostatic forces pull the electrodes together. If the applied voltage exceeds a threshold, the movable reflective layer 14 can deform and move near or against the optical stack 16. A dielectric layer (not shown) within the optical stack 16 may prevent shorting and control the separation distance between the layers 14 and 16, as illustrated by the actuated display element 12 on the right in FIG. 1. The behavior can be the same regardless of the polarity of the applied potential difference. Though a series of display elements in an array may be referred to in some instances as "rows" or "columns," a person having ordinary skill in the art will readily understand that referring to one direction as a "row" and another as a "column" is arbitrary. Restated, in some orientations, the rows can be considered columns, and the columns considered to be rows. In some implementations, the rows may be referred to as "common" lines and the columns may be referred to as "segment" lines, or vice versa. Furthermore, the display elements may be evenly arranged in orthogonal rows and columns (an "array"), or arranged in non-linear configurations, for example, having certain positional offsets with respect to one another (a "mosaic"). The terms "array" and "mosaic" may refer to either configuration. Thus, although the display is referred to as including an "array" or "mosaic," the elements themselves need not be arranged orthogonally to one another, or disposed in an even distribution, in any instance, but may include arrangements having asymmetric shapes and unevenly distributed elements.

Figure 2:
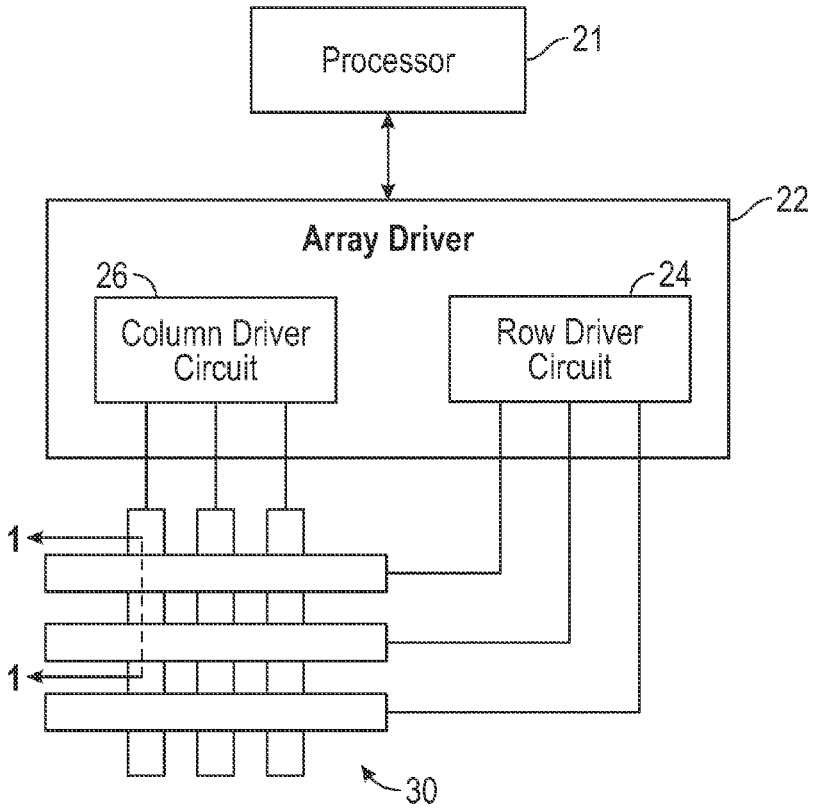
FIG. 2 is a system block diagram illustrating an electronic device incorporating an IMOD-based display including a three element by three element array of IMOD display elements.

FIG. 2 is a system block diagram illustrating an electronic device incorporating an IMOD-based display including a three element by three element array of IMOD display elements. The electronic device includes a processor 21 that may be configured to execute one or more software modules. In addition to executing an operating system, the processor 21 may be configured to execute one or more software applications, including a web browser, a telephone application, an email program, or any other software application.

The processor 21 can be configured to communicate with an array driver 22. The array driver 22 can include a row driver circuit 24 and a column driver circuit 26 that provide signals to, for example a display array or panel 30. The cross section of the IMOD display device illustrated in FIG. 1 is shown by the lines 1-1 in FIG. 2. Although FIG. 2 illustrates a 3×3 array of IMOD display elements for the sake of clarity, the display array 30 may contain a very large number of IMOD display elements, and may have a different number of IMOD display elements in rows than in columns, and vice versa.

Figures 3, 4:
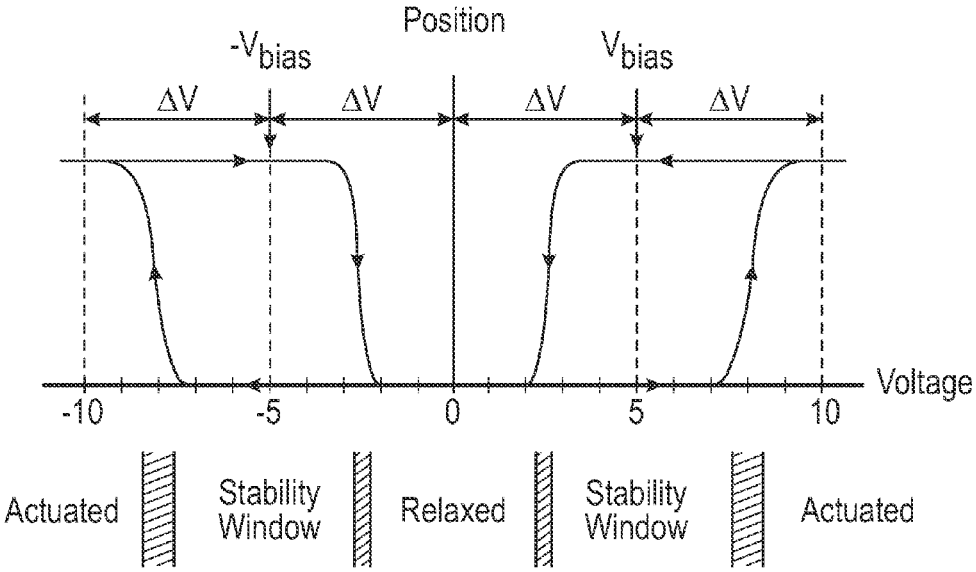
FIG. 3 is a graph illustrating movable reflective layer position versus applied voltage for an IMOD display element.
FIG. 4 is a table illustrating various states of an IMOD display element when various common and segment voltages are applied.

FIG. 3 is a graph illustrating movable reflective layer position versus applied voltage for an IMOD display element. For IMODs, the row/column (i.e., common/segment) write procedure may take advantage of a hysteresis property of the display elements as illustrated in FIG. 3. An IMOD display element may use, in one example implementation, about a 10-volt potential difference to cause the movable reflective layer, or mirror, to change from the relaxed state to the actuated state. When the voltage is reduced from that value, the movable reflective layer maintains its state as the voltage drops back below, in this example, 10 volts, however, the movable reflective layer does not relax completely until the voltage drops below 2 volts. Thus, a range of voltage, approximately 3-7 volts, in the example of FIG. 3, exists where there is a window of applied voltage within which the element is stable in either the relaxed or actuated state. This is referred to herein as the "hysteresis window" or "stability window." For a display array 30 having the hysteresis characteristics of FIG. 3, the row/column write procedure can be designed to address one or more rows at a time. Thus, in this example, during the addressing of a given row, display elements that are to be actuated in the addressed row can be exposed to a voltage difference of about 10 volts, and display elements that are to be relaxed can be exposed to a voltage difference of near zero volts. After addressing, the display elements can be exposed to a steady state or bias voltage difference of approximately 5 volts in this example, such that they remain in the previously strobed, or written, state. In this example, after being addressed, each display element sees a potential difference within the "stability window" of about 3-7 volts. This hysteresis property feature enables the IMOD display element design to remain stable in either an actuated or relaxed pre-existing state under the same applied voltage conditions. Since each IMOD display element, whether in the actuated or relaxed state, can serve as a capacitor formed by the fixed and moving reflective layers, this stable state can be held at a steady voltage within the hysteresis window without substantially consuming or losing power. Moreover, essentially little or no current flows into the display element if the applied voltage potential remains substantially fixed.

In some implementations, a frame of an image may be created by applying data signals in the form of "segment" voltages along the set of column electrodes, in accordance with the desired change (if any) to the state of the display elements in a given row. Each row of the array can be addressed in turn, such that the frame is written one row at a time. To write the desired data to the display elements in a first row, segment voltages corresponding to the desired state of the display elements in the first row can be applied on the column electrodes, and a first row pulse in the form of a specific "common" voltage or signal can be applied to the first row electrode. The set of segment voltages can then be changed to correspond to the desired change (if any) to the state of the display elements in the second row, and a second common voltage can be applied to the second row electrode. In some implementations, the display elements in the first row are unaffected by the change in the segment voltages applied along the column electrodes, and remain in the state they were set to during the first common voltage row pulse. This process may be repeated for the entire series of rows, or alternatively, columns, in a sequential fashion to produce the image frame. The frames can be refreshed and/or updated with new image data by continually repeating this process at some desired number of frames per second.

The combination of segment and common signals applied across each display element (that is, the potential difference across each display element or pixel) determines the resulting state of each display element. FIG. 4 is a table illustrating various states of an IMOD display element when various common and segment voltages are applied. As will be readily understood by one having ordinary skill in the art, the "segment" voltages can be applied to either the column electrodes or the row electrodes, and the "common" voltages can be applied to the other of the column electrodes or the row electrodes.

As illustrated in FIG. 4, when a release voltage $VC_{REL}$ is applied along a common line, all IMOD display elements along the common line will be placed in a relaxed state, alternatively referred to as a released or unactuated state, regardless of the voltage applied along the segment lines, i.e., high segment voltage $VS_H$ and low segment voltage $VS_L$. In particular, when the release voltage $VC_{REL}$ is applied along a common line, the potential voltage across the modulator display elements or pixels (alternatively referred to as a display element or pixel voltage) can be within the relaxation window (see FIG. 3, also referred to as a release window) both when the high segment voltage $VS_H$ and the low segment voltage $VS_L$ are applied along the corresponding segment line for that display element.

When a hold voltage is applied on a common line, such as a high hold voltage $VC_{HOLD_H}$ or a low hold voltage $VC_{HOLD_L}$, the state of the IMOD display element along that common line will remain constant. For example, a relaxed IMOD display element will remain in a relaxed position, and an actuated IMOD display element will remain in an actuated position. The hold voltages can be selected such that the display element voltage will remain within a stability window both when the high segment voltage $VS_H$ and the low segment voltage $VS_L$ are applied along the corresponding segment line. Thus, the segment voltage swing in this example is the difference between the high $VS_H$ and low segment voltage $VS_L$, and is less than the width of either the positive or the negative stability window.

When an addressing, or actuation, voltage is applied on a common line, such as a high addressing voltage $VC_{ADD_H}$ or a low addressing voltage $VC_{ADD_L}$, data can be selectively written to the modulators along that common line by application of segment voltages along the respective segment lines. The segment voltages may be selected such that actuation is dependent upon the segment voltage applied. When an addressing voltage is applied along a common line, application of one segment voltage will result in a display element voltage within a stability window, causing the display element to remain unactuated. In contrast, application of the other segment voltage will result in a display element voltage beyond the stability window, resulting in actuation of the display element. The particular segment voltage which causes actuation can vary depending upon which addressing voltage is used. In some implementations, when the high addressing voltage $VC_{ADD_H}$ is applied along the common line, application of the high segment voltage $VS_H$ can cause a modulator to remain in its current position, while application of the low segment voltage $VS_L$ can cause actuation of the modulator. As a corollary, the effect of the segment voltages can be the opposite when a low addressing voltage $VC_{ADD_L}$ is applied, with high segment voltage $VS_H$ causing actuation of the modulator, and low segment voltage $VS_L$ having substantially no effect (i.e., remaining stable) on the state of the modulator.

In some implementations, hold voltages, address voltages, and segment voltages may be used which produce the same polarity potential difference across the modulators. In some other implementations, signals can be used which alternate the polarity of the potential difference of the modulators from time to time. Alternation of the polarity across the modulators (that is, alternation of the polarity of write procedures) may reduce or inhibit charge accumulation that could occur after repeated write operations of a single polarity.

Figure 5:
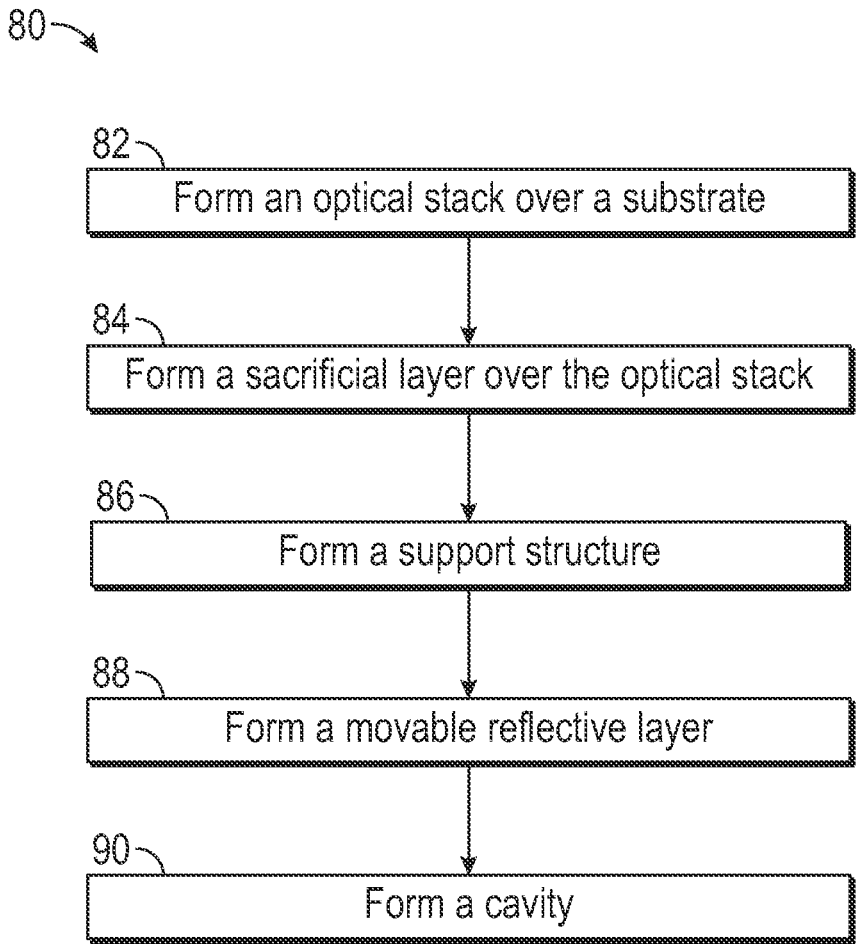
FIG. 5 is a flow diagram illustrating a manufacturing process for an IMOD display or display element.
Figure 6A:
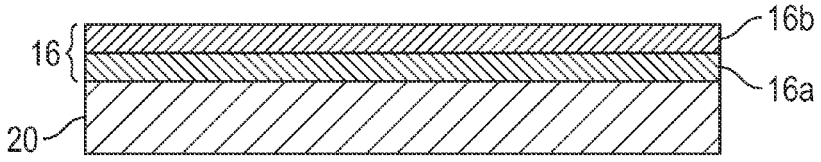
FIGS. 6A-6E are cross-sectional illustrations of various stages in a process of making an IMOD display or display element.

FIG. 5 is a flow diagram illustrating a manufacturing process 80 for an IMOD display or display element. FIGS. 6A-6E are cross-sectional illustrations of various stages in the manufacturing process 80 for making an IMOD display or display element. In some implementations, the manufacturing process 80 can be implemented to manufacture one or more EMS devices, such as IMOD displays or display elements. The manufacture of such an EMS device also can include other blocks not shown in FIG. 5. The process 80 begins at block 82 with the formation of the optical stack 16 over the substrate 20. FIG. 6A illustrates such an optical stack 16 formed over the substrate 20. The substrate 20 may be a transparent substrate such as glass or plastic such as the materials discussed above with respect to FIG. 1. The substrate 20 may be flexible or relatively stiff and unbending, and may have been subjected to prior preparation processes, such as cleaning, to facilitate efficient formation of the optical stack 16. As discussed above, the optical stack 16 can be electrically conductive, partially transparent, partially reflective, and partially absorptive, and may be fabricated, for example, by depositing one or more layers having the desired properties onto the transparent substrate 20.

In FIG. 6A, the optical stack 16 includes a multilayer structure having sub-layers 16*a* and 16*b*, although more or fewer sub-layers may be included in some other implementations. In some implementations, one of the sub-layers 16*a* and 16*b* can be configured with both optically absorptive and electrically conductive properties, such as the combined conductor/absorber sub-layer 16*a*. In some implementations, one of the sub-layers 16*a* and 16*b* can include molybdenum-chromium (molychrome or MoCr), or other materials with a suitable complex refractive index. Additionally, one or more of the sub-layers 16*a* and 16*b* can be patterned into parallel strips, and may form row electrodes in a display device. Such patterning can be performed by a masking and etching process or another suitable process known in the art. In some implementations, one of the sub-layers 16*a* and 16*b* can be an insulating or dielectric layer, such as an upper sub-layer 16*b* that is deposited over one or more underlying metal and/or oxide layers (such as one or more reflective and/or conductive layers). In addition, the optical stack 16 can be patterned into individual and parallel strips that form the rows of the display. In some implementations, at least one of the sub-layers of the optical stack, such as the optically absorptive layer, may be quite thin (e.g., relative to other layers depicted in this disclosure), even though the sub-layers 16*a* and 16*b* are shown somewhat thick in FIGS. 6A-6E.

Figure 6B:
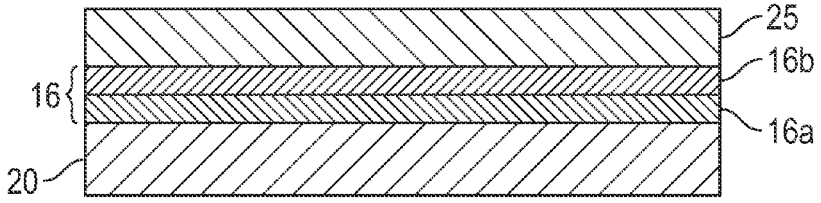

The process 80 continues at block 84 with the formation of a sacrificial layer 25 over the optical stack 16. Because the sacrificial layer 25 is later removed (see block 90) to form the cavity 19, the sacrificial layer 25 is not shown in the resulting IMOD display elements. FIG. 6B illustrates a partially fabricated device including a sacrificial layer 25 formed over the optical stack 16. The formation of the sacrificial layer 25 over the optical stack 16 may include deposition of a xenon difluoride ($XeF_2$)-etchable material such as molybdenum (Mo) or amorphous silicon (Si), in a thickness selected to provide, after subsequent removal, a gap or cavity 19 (see also FIG. 6E) having a desired design size. Deposition of the sacrificial material may be carried out using deposition techniques such as physical vapor deposition (PVD, which includes many different techniques, such as sputtering), plasma-enhanced chemical vapor deposition (PECVD), thermal chemical vapor deposition (thermal CVD), or spin-coating.

Figure 6C:
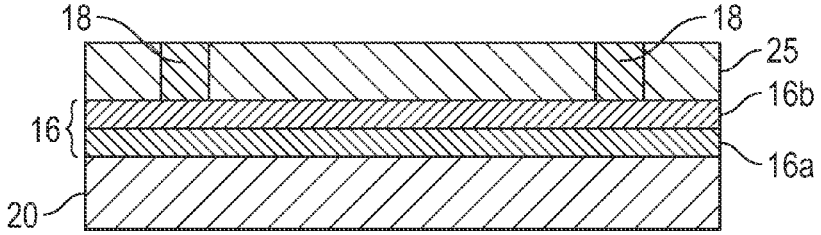

The process 80 continues at block 86 with the formation of a support structure such as a support post 18. The formation of the support post 18 may include patterning the sacrificial layer 25 to form a support structure aperture, then depositing a material (such as a polymer or an inorganic material, like silicon oxide) into the aperture to form the support post 18, using a deposition method such as PVD, PECVD, thermal CVD, or spin-coating. In some implementations, the support structure aperture formed in the sacrificial layer can extend through both the sacrificial layer 25 and the optical stack 16 to the underlying substrate 20, so that the lower end of the support post 18 contacts the substrate 20. Alternatively, as depicted in FIG. 6C, the aperture formed in the sacrificial layer 25 can extend through the sacrificial layer 25, but not through the optical stack 16. For example, FIG. 6E illustrates the lower ends of the support posts 18 in contact with an upper surface of the optical stack 16. The support post 18, or other support structures, may be formed by depositing a layer of support structure material over the sacrificial layer 25 and patterning portions of the support structure material located away from apertures in the sacrificial layer 25. The support structures may be located within the apertures, as illustrated in FIG. 6C, but also can extend at least partially over a portion of the sacrificial layer 25. As noted above, the patterning of the sacrificial layer 25 and/or the support posts 18 can be performed by a masking and etching process, but also may be performed by alternative patterning methods.

Figure 6D:
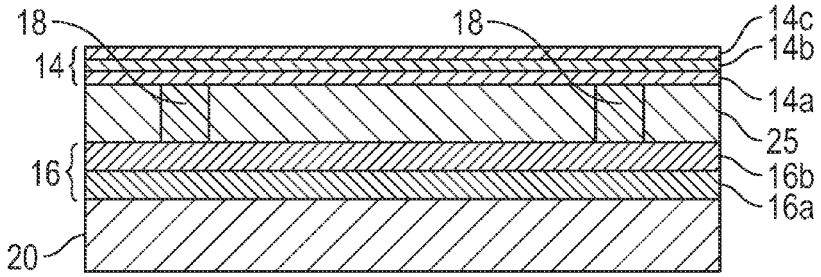
Figure 6E:
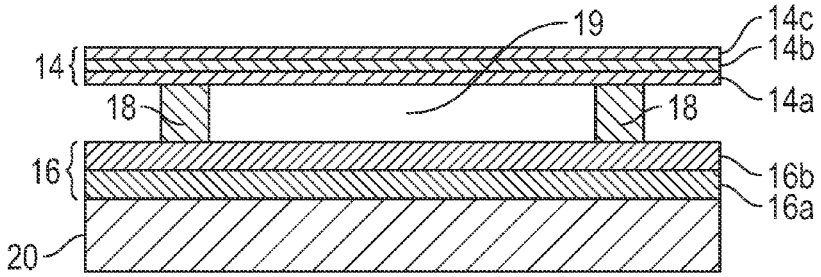

The process 80 continues at block 88 with the formation of a movable reflective layer or membrane such as the movable reflective layer 14 illustrated in FIG. 6D. The movable reflective layer 14 may be formed by employing one or more deposition steps, including, for example, reflective layer (such as aluminum, aluminum alloy, or other reflective materials) deposition, along with one or more patterning, masking and/or etching steps. The movable reflective layer 14 can be patterned into individual and parallel strips that form, for example, the columns of the display. The movable reflective layer 14 can be electrically conductive, and referred to as an electrically conductive layer. In some implementations, the movable reflective layer 14 may include a plurality of sub-layers 14*a*, 14*b* and 14*c* as shown in FIG. 6D. In some implementations, one or more of the sub-layers, such as sub-layers 14*a* and 14*c*, may include highly reflective sub-layers selected for their optical properties, and another sub-layer 14*b* may include a mechanical sub-layer selected for its mechanical properties. In some implementations, the mechanical sub-layer may include a dielectric material. Since the sacrificial layer 25 is still present in the partially fabricated IMOD display element formed at block 88, the movable reflective layer 14 is typically not movable at this stage. A partially fabricated IMOD display element that contains a sacrificial layer 25 also may be referred to herein as an "unreleased" IMOD.

The process 80 continues at block 90 with the formation of a cavity 19. The cavity 19 may be formed by exposing the sacrificial material 25 (deposited at block 84) to an etchant. For example, an etchable sacrificial material such as Mo or amorphous Si may be removed by dry chemical etching by exposing the sacrificial layer 25 to a gaseous or vaporous etchant, such as vapors derived from solid $XeF_2$ for a period of time that is effective to remove the desired amount of material. The sacrificial material is typically selectively removed relative to the structures surrounding the cavity 19. Other etching methods, such as wet etching and/or plasma etching, also may be used. Since the sacrificial layer 25 is removed during block 90, the movable reflective layer 14 is typically movable after this stage. After removal of the sacrificial material 25, the resulting fully or partially fabricated IMOD display element may be referred to herein as a "released" IMOD.

In some implementations, the packaging of an EMS component or device, such as an IMOD-based display, can include a backplate (alternatively referred to as a backplane, back glass or recessed glass) which can be configured to protect the EMS components from damage (such as from mechanical interference or potentially damaging substances). The backplate also can provide structural support for a wide range of components, including but not limited to driver circuitry, processors, memory, interconnect arrays, vapor barriers, product housing, and the like. In some implementations, the use of a backplate can facilitate integration of components and thereby reduce the volume, weight, and/or manufacturing costs of a portable electronic device.

Figure 7A:
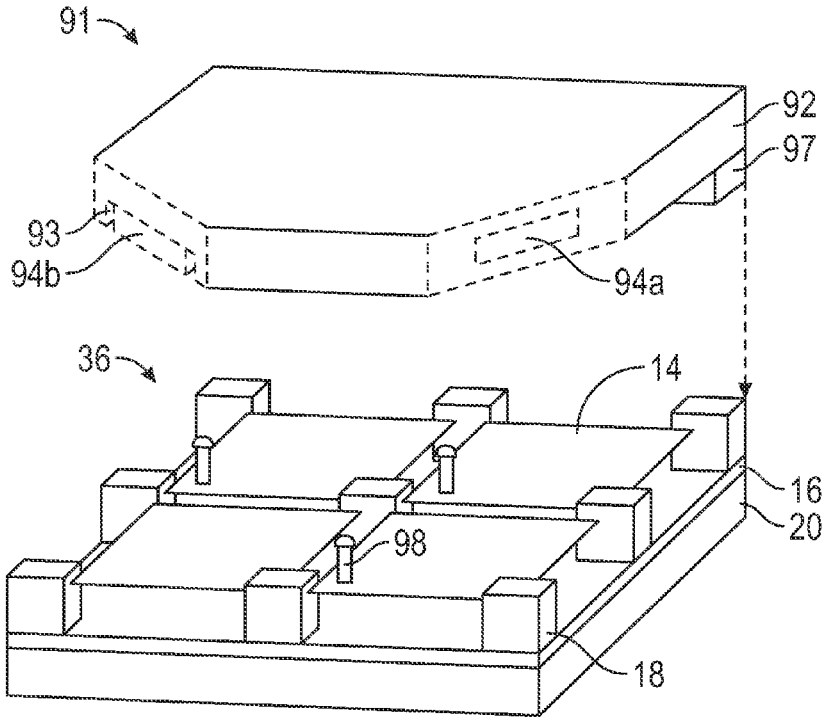
FIGS. 7A and 7B are schematic exploded partial perspective views of a portion of an electromechanical systems (EMS) package including an array of EMS elements and a backplate.
Figure 7B:
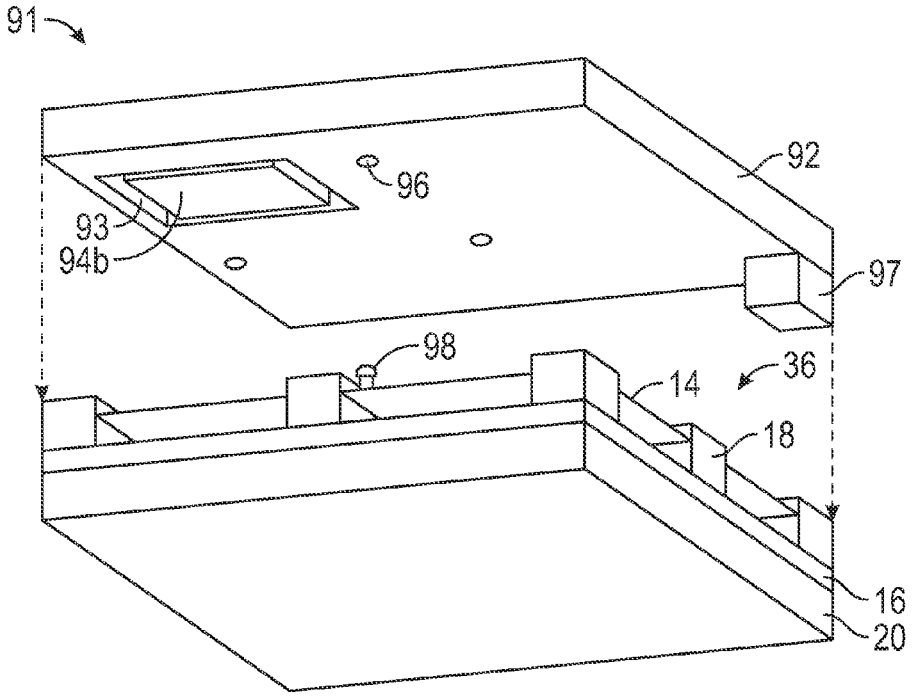

FIGS. 7A and 7B are schematic exploded partial perspective views of a portion of an EMS package 91 including an array 36 of EMS elements and a backplate 92. FIG. 7A is shown with two corners of the backplate 92 cut away to better illustrate certain portions of the backplate 92, while FIG. 7B is shown without the corners cut away. The EMS array 36 can include a substrate 20, support posts 18, and a movable layer 14. In some implementations, the EMS array 36 can include an array of IMOD display elements with one or more optical stack portions 16 on a transparent substrate, and the movable layer 14 can be implemented as a movable reflective layer.

The backplate 92 can be essentially planar or can have at least one contoured surface (e.g., the backplate 92 can be formed with recesses and/or protrusions). The backplate 92 may be made of any suitable material, whether transparent or opaque, conductive or insulating. Suitable materials for the backplate 92 include, but are not limited to, glass, plastic, ceramics, polymers, laminates, metals, metal foils, Kovar and plated Kovar.

As shown in FIGS. 7A and 7B, the backplate 92 can include one or more backplate components 94*a* and 94*b*, which can be partially or wholly embedded in the backplate 92. As can be seen in FIG. 7A, backplate component 94*a* is embedded in the backplate 92. As can be seen in FIGS. 7A and 7B, backplate component 94*b* is disposed within a recess 93 formed in a surface of the backplate 92. In some implementations, the backplate components 94*a* and/or 94*b* can protrude from a surface of the backplate 92. Although backplate component 94*b* is disposed on the side of the backplate 92 facing the substrate 20, in other implementations, the backplate components can be disposed on the opposite side of the backplate 92.

The backplate components 94*a* and/or 94*b* can include one or more active or passive electrical components, such as transistors, capacitors, inductors, resistors, diodes, switches, and/or integrated circuits (ICs) such as a packaged, standard or discrete IC. Other examples of backplate components that can be used in various implementations include antennas, batteries, and sensors such as electrical, touch, optical, or chemical sensors, or thin-film deposited devices.

In some implementations, the backplate components 94*a* and/or 94*b* can be in electrical communication with portions of the EMS array 36. Conductive structures such as traces, bumps, posts, or vias may be formed on one or both of the backplate 92 or the substrate 20 and may contact one another or other conductive components to form electrical connections between the EMS array 36 and the backplate components 94*a* and/or 94*b*. For example, FIG. 7B includes one or more conductive vias 96 on the backplate 92 which can be aligned with electrical contacts 98 extending upward from the movable layers 14 within the EMS array 36. In some implementations, the backplate 92 also can include one or more insulating layers that electrically insulate the backplate components 94*a* and/or 94*b* from other components of the EMS array 36. In some implementations in which the backplate 92 is formed from vapor-permeable materials, an interior surface of backplate 92 can be coated with a vapor barrier (not shown).

The backplate components 94*a* and 94*b* can include one or more desiccants which act to absorb any moisture that may enter the EMS package 91. In some implementations, a desiccant (or other moisture absorbing materials, such as a getter) may be provided separately from any other backplate components, for example as a sheet that is mounted to the backplate 92 (or in a recess formed therein) with adhesive. Alternatively, the desiccant may be integrated into the backplate 92. In some other implementations, the desiccant may be applied directly or indirectly over other backplate components, for example by spray-coating, screen printing, or any other suitable method.

In some implementations, the EMS array 36 and/or the backplate 92 can include mechanical standoffs 97 to maintain a distance between the backplate components and the display elements and thereby prevent mechanical interference between those components. In the implementation illustrated in FIGS. 7A and 7B, the mechanical standoffs 97 are formed as posts protruding from the backplate 92 in alignment with the support posts 18 of the EMS array 36. Alternatively or in addition, mechanical standoffs, such as rails or posts, can be provided along the edges of the EMS package 91.

Although not illustrated in FIGS. 7A and 7B, a seal can be provided which partially or completely encircles the EMS array 36. Together with the backplate 92 and the substrate 20, the seal can form a protective cavity enclosing the EMS array 36. The seal may be a semi-hermetic seal, such as a conventional epoxy-based adhesive. In some other implementations, the seal may be a hermetic seal, such as a thin film metal weld or a glass frit. In some other implementations, the seal may include polyisobutylene (PIB), polyurethane, liquid spin-on glass, solder, polymers, plastics, or other materials. In some implementations, a reinforced sealant can be used to form mechanical standoffs.

In alternate implementations, a seal ring may include an extension of either one or both of the backplate 92 or the substrate 20. For example, the seal ring may include a mechanical extension (not shown) of the backplate 92. In some implementations, the seal ring may include a separate member, such as an O-ring or other annular member.

In some implementations, the EMS array 36 and the backplate 92 are separately formed before being attached or coupled together. For example, the edge of the substrate 20 can be attached and sealed to the edge of the backplate 92 as discussed above. Alternatively, the EMS array 36 and the backplate 92 can be formed and joined together as the EMS package 91. In some other implementations, the EMS package 91 can be fabricated in any other suitable manner, such as by forming components of the backplate 92 over the EMS array 36 by deposition.

Various implementations of a multi-primary display device can include the EMS array 36. The EMS elements in the array can include one or more IMODs. In some implementations the IMOD can include an analog IMOD (AIMOD). The AIMOD may be configured to selectively reflect multiple primary colors and provide 1 bit per color.

Figure 8:
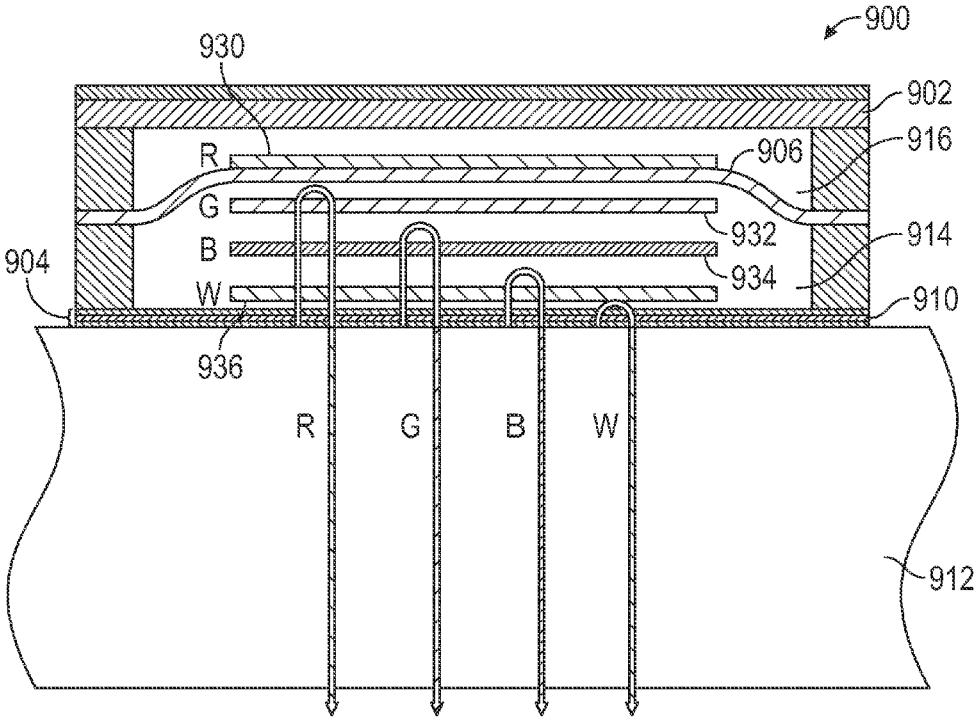
FIG. 8 shows a cross-section of an implementation of an analog IMOD (AIMOD).

FIG. 8 shows a cross-section of an implementation of an AIMOD. The AIMOD 900 includes a substrate 912 and an optical stack 904 disposed over the substrate 912. The AIMOD includes a first electrode 910 and a second electrode 902 (as illustrated, the first electrode 910 is a lower electrode, and second electrode 902 is an upper electrode). The AIMOD 900 also includes a movable reflective layer 906 disposed between the first electrode 910 and the second electrode 902. In some implementations, the optical stack 904 includes an absorbing layer, and/or a plurality of other layers. In some implementations, and in the example illustrated in FIG. 8, the optical stack 904 includes the first electrode 910 which is configured as an absorbing layer. In such a configuration, the absorbing layer (first electrode 910) can be an approximately 6 nm layer of material that includes MoCr. In some implementations, the absorbing layer (that is, the first electrode 910) can be a layer of material including MoCr with a thickness ranging from approximately 2 nm to 50 nm.

The reflective layer 906 can be actuated toward either the first electrode 910 or the second electrode 902 when a voltage is applied between the first and second electrodes 910 and 902. In this manner, the reflective layer 906 can be driven through a range of positions between the two electrodes 902 and 910, including above and below a relaxed (unactuated) state. For example, FIG. 8 illustrates that the reflective layer 906 can be moved to various positions 930, 932, 934 and 936 between the first electrode 910 and the second electrode 902.

The AIMOD 900 in FIG. 8 has two structural cavities, a first cavity 914 between the reflective layer 906 and the optical stack 904, and a second cavity 916 between the reflective layer 906 and the second electrode 902. In various implementations, the first cavity 914 and/or the second cavity can include air. The color and/or intensity of light reflected by the AIMOD 900 is determined by the distance between the reflective layer 906 and the absorbing layer (first electrode 910).

The AIMOD 900 can be configured to selectively reflect certain wavelengths of light depending on the configuration of the AIMOD. The distance between the first electrode 910, which in this implementation acts as an absorbing layer and the reflective layer 906 changes the reflective properties of the AIMOD 900. Any particular wavelength is maximally reflected from the AIMOD 900 when the distance between the reflective layer 906 and the absorbing layer (first electrode 910) is such that the absorbing layer (first electrode 910) is located at the minimum light intensity of standing waves resulting from interference between incident light and light reflected from the reflective layer 906. For example, as illustrated, the AIMOD 900 is designed to be viewed from the substrate 912 side of the AIMOD (through the substrate 912), that is, light enters the AIMOD 900 through the substrate 912. Depending on the position of the reflective layer 906, different wavelengths of light are reflected back through the substrate 912, which gives the appearance of different colors. These different colors are also referred to as native or primary colors. The number of primary colors produced by the AIMOD 900 can be greater than 4. For example, the number of primary colors produced by the AIMOD 900 can be 5, 6, 8, 10, 16, 18, 33, etc.

A position of the movable layer 906 at a location such that it reflects a certain wavelength or wavelengths can be referred to as a display state of the AIMOD 900. For example, when the reflective layer 906 is in position 930, red wavelengths of light are reflected in greater proportion than other wavelengths and the other wavelengths of light are absorbed in greater proportion than red. Accordingly, the AIMOD 900 appears red and is said to be in a red display state, or simply a red state. Similarly, the AIMOD 900 is in a green display state (or green state) when the reflective layer 906 moves to position 932, where green wavelengths of light are reflected in greater proportion than other wavelengths and the other wavelengths of light are absorbed in greater proportion than green. When the reflective layer 906 moves to position 934, the AIMOD 900 is in a blue display state (or blue state) and blue wavelengths of light are reflected in greater proportion than other wavelengths and the other wavelengths of light are absorbed in greater proportion than blue. When the reflective layer 906 moves to a position 936, the AIMOD 900 is in a white display state (or white state) and a broad range of wavelengths of light in the visible spectrum are substantially reflected such that and the AIMOD 900 appears "gray" or in some cases "silver," and having low total reflection (or luminance) when a bare metal reflector is used. In some cases increased total reflection (or luminance) can be achieved with the addition of dielectric layers disposed on the metal reflector, but the reflected color may be tinted with blue, green or yellow, depending on the exact position of 936. In some implementations, in position 936, configured to produce a white state, the distance between the reflective layer 906 and the first electrode 910 is between about 0 and 20 nm. In other implementations, the AIMOD 900 can take on different states and selectively reflect other wavelengths of light based on the position of the reflective layer 906, and also based on materials that are used in construction of the AIMOD 900, particularly various layers in the optical stack 904.

The multiple primary colors displayed by a display element (for example, AIMOD 900) and the possible color combinations of the multiple primary colors displayed by a display element can represent a color gamut associated with the display element. A color associated with the display device can be identified by color levels that represent tone, grayscale, hue, chroma, saturation, brightness, lightness, luminance, correlated color temperature, dominant wavelength, or color coordinates in a color space.

Figure 9:
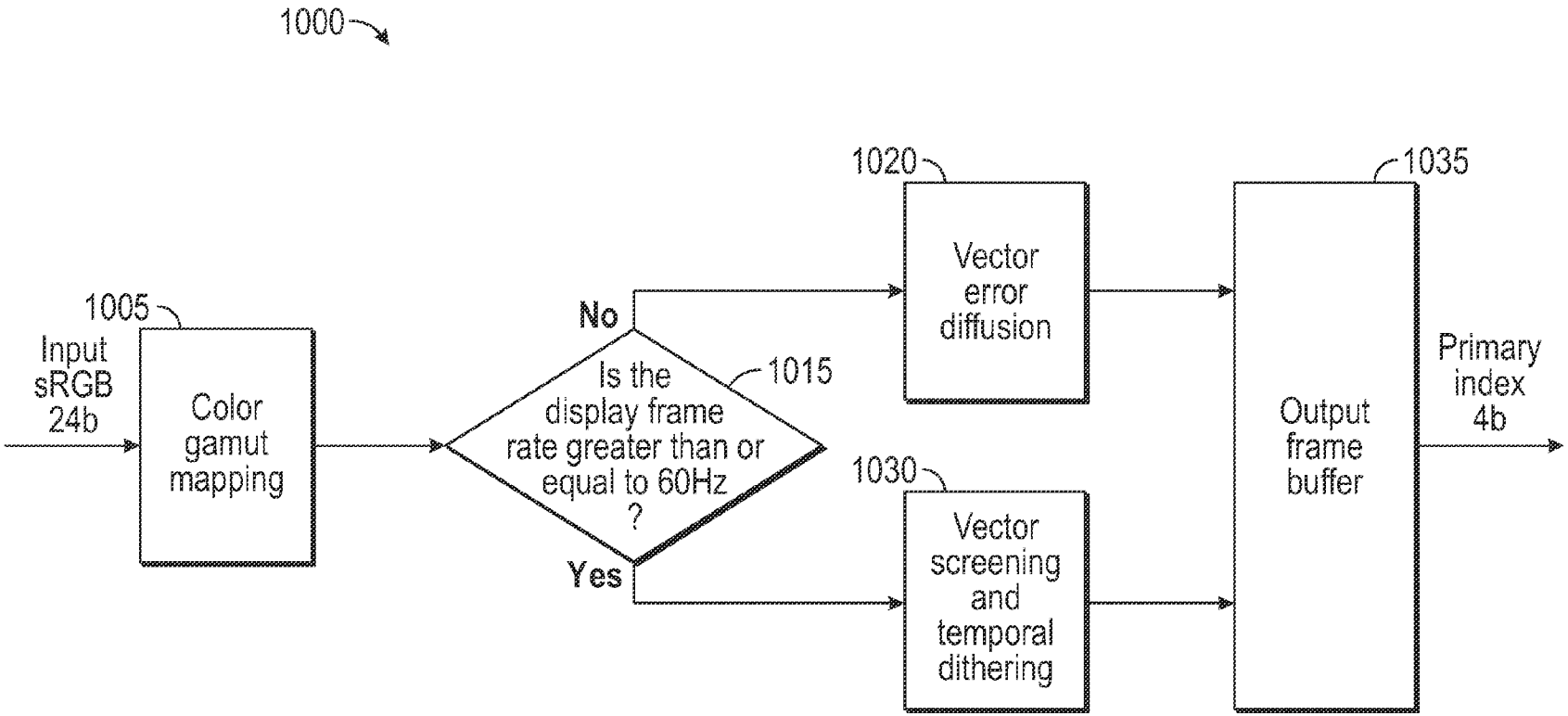
FIG. 9 is a functional diagram that describes an implementation of a method of displaying an image on a multi-primary display device.

FIG. 9 is a functional block diagram that describes an implementation of a method 1000 of displaying an image on a multi-primary display device. Various implementations of the multi-primary display device can include an AIMOD 900. The various functional blocks illustrated in FIG. 9 can be implemented with processors executing instructions included in a machine-readable non-transitory storage medium, such as a RAM, ROM, EEPROM, etc. The various functional blocks can be implemented with electronic processors, micro-controllers, FPGA's, etc. The various functional blocks illustrated in FIG. 9 are described below.

The functional block 1005 is a color gamut mapping unit that is configured to receive an input image including a plurality of colors in an input color gamut and map it to a device color gamut associated with the display device.

The functional block 1015 in FIG. 9 is an operation mode selector. The operation mode selector 1015 is configured to choose one of the two display modes. A first display mode is a standard display mode. The standard display mode is a dynamic display mode, in which a display state of some or all of the various display elements is changed such that the image is displayed at a frame rate equal to or greater than 60 Hz. A second display mode is an always-on mode. In the always-on mode, an image is displayed at a frame rate less than 60 Hz such that the displayed image appears to be static over a period of time. In various implementations, the operation mode can depend on the display device frame rate. For example, if the display device is operating/running at frame rates greater than or equal to 60 Hz, images and/or videos are displayed using a standard mode wherein images and/or videos processed by a vector screening and temporal dithering halftoning unit 1030 are displayed. As another example, if the display device is operating/running at frame rates less than 60 Hz, images and/or videos are displayed using an always-on mode wherein images processed by a vector error diffusion halftoning unit 1020 are displayed.

The images rendered by the display device using the standard mode or the always-on mode can be stored in an output buffer 1035. In various implementations, the mode selector 1015 can be capable of detecting the status of the display frame rate. Additionally, the mode selector 1015 can be configured to function correspondingly if the display device receives commands from a host or a power-control unit to change the display mode. For example, in various implementations, the selector 1015 can switch to the always-on mode and retrieve the image stored in the output frame buffer 1035 to generate a new output image for always-on display when the host stops sending video input and an always-on display is desired.

The vector error diffusion based halftoning unit 1020 can render an image and/or video using vector error diffusion. Without subscribing to any particular theory, vector error diffusion includes halftoning methods in which a color difference (or an error) between the color of an incoming image pixel and the color of the corresponding display pixel to which the incoming image pixel is mapped is distributed to neighboring pixels.

The vector screening and temporal dithering unit 1030 can be used to render an image and/or video using vector screening. Without subscribing to any particular theory, screening includes halftoning methods in which the color of an incoming image pixel is compared with a screen that is constructed to have specific properties. The color of the corresponding display pixel to which the incoming image pixel is mapped is determined based on the comparison.

Without subscribing to any particular theory, vector error diffusion method can render static images better than vector screening method, while vector screening method can render video images better than vector error diffusion method. Vector screening method can be more robust to moving objects and have fewer motion artifacts while rendering videos of moving objects. Combining temporal dithering with error diffusion based or screening based methods can further increase image quality of rendered images. Vector error diffusion and vector screening can be implemented using a programmable circuit or a processor (for example, units 1020 and 1030).

The output frame buffer 1035 is configured to store output from the two units 1020 and 1030 described above. In various implementations, two or more frames can be used for the output generated by the vector screening and temporal dithering unit 1030 and only one frame is used for the output generated by the vector error diffusion based unit 1020. Besides being used for the situation when the frame rate of the display device is higher than the frame rate of the input signal, the output frame buffer 1035 can also provide the input for the input image retrieval unit as described below. In various implementations, the size of the required output frame buffer can be 400×400×2×4 bits, where 4 bits are used for storing the primary index for each pixel in each frame and 2 frames are used for a display device operating/running at 60 Hz. If the display device is operating/running at higher frame rate, the output buffer 1035 may contain more frames. For example, in various implementations, 3 frames may be used for a display device operating at 90 Hz frame rate and 4 frames may be used for a display device operating at 120 Hz frame rate.

As discussed above, the color gamut mapping unit functional block 1005 can receive an input image including a plurality of colors in an input color gamut and map it to a display color gamut. The color gamut mapping unit 1005 can use a variety of methods to map the colors of an input image from the input color gamut to the display color gamut. For example, the colors of an input image can be mapped from the input color gamut to the display color gamut using an interpolation method which employs Delaunay triangulation to locate the color of an input image pixel in the input color gamut in a polyhedron in the display color gamut formed by multiple primary colors in the display color space. Identifying the polyhedron in the display color gamut can be computationally intensive and require a large amount of processing power and/or memory. Accordingly, color mapping methods that can be computationally less intensive and require smaller amount of processing power and/or memory are desirable.

Primary Matched Gamut Mapping

Figure 10A:
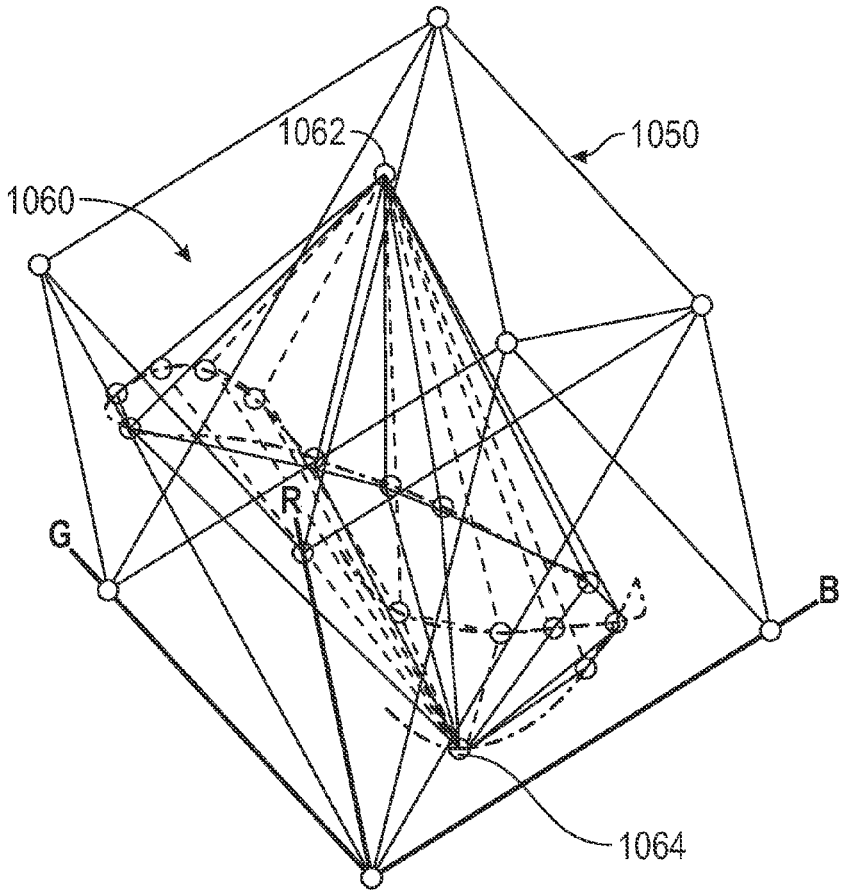
FIG. 10A shows an example of a color gamut associated with a multi-primary display device including at least one display element in the sRGB color space.

FIG. 10A shows an example of a color gamut 1060 associated with a multi-primary display device including at least one display element and the color gamut 1050 of the input image. The display element can include an implementation of an IMOD (e.g., an AIMOD 900). The gamut 1050 is formed by the input primary colors specified within a given range in the image color space. For example, if the image color space is a standard sRGB color space and RGB values, r, g and b, are limited between 0 and 255, then the gamut 1050 is a cube formed by white (W: r=255, g=255, b=255) point of the sRGB color space, black (K: r=0, g=0, b=0) point of the sRGB color space, the three saturated primary colors red (R: r=255, g=0, b=0), green (G: r=0, g=255, b=0) and blue (B: r=0, g=0, b=255) of the sRGB color space and their combinations cyan (C: r=0, g=255, b=255), magenta (M: r=255, g=0, b=255) and yellow (Y: r=255, g=255, b=0).

The gamut 1060 is formed by the white (W) primary of the display color gamut, black (K) primary of the display color gamut and a plurality of non-white and non-black device primary colors that can be produced by the multi-primary display device. All possible colors that can be displayed by the multi-primary display device are included in the gamut 1060. In various implementations of the display device including an IMOD (e.g., an AIMOD 900), the gamut 1060 can be a polyhedron with the device white (W) primary 1062 located at one corner of the polyhedron, the device black (K) primary 1064 located at another corner of the polyhedron. The device white primary 1062 and the device black primary 1064 are connected to the plurality of non-white and non-black device primary colors located on a spiral curve. In the implementation illustrated in FIG. 10A, the gamut 1060 includes 14 non-white and non-black device primary colors selected from all the possible primary colors that can be displayed by the display device. In other implementations, the gamut 1060 can include less than or greater than 14 non-white and non-black device primary colors. For example, the gamut 1060 can include 4, 6, 8, 10, 12, 18, 22, 30, 62, 126 or 254 non-white and non-black device primary colors. In various implementations, the number of non-white and non-black device primary colors in the gamut 1060 can be greater than or equal to 4 and less than or equal to 256. In various implementations, some or all of the selected plurality of non-white and non-black device primary colors can be within the gamut 1050 such that most or all of the colors in the gamut 1060 are within the gamut 1050.

Image colors that are not within the gamut 1060 can be mapped to the gamut 1060 using a variety of mapping methods. For example, in some implementations, a tetrahedral interpolation method based three-dimensional (3D) look-up table (LUT) can be used to map the color of an input image pixel from the input color gamut to the display color gamut. In various implementations, a primary matched gamut mapping method as described below can also be used to map the color of an input image pixel from the input color gamut to the display color gamut.

Although each IMOD based display element of a display device can display only one of the selected primary colors at a given moment, by spatial and/or temporal color mixing the perceived color by an observer of such display device is a spatially and/or temporally blended color of all primary colors as the result of the applied spatial and/or temporal dithering. The primary matched gamut mapping method is based on the recognition that such blended colors displayed by a display device including at least one IMOD based display element can be represented by linear combinations of the selected device primary colors. The linear relation is accurate if all selected device primary colors and their combinations can be represented as standard colors in the CIE XYZ color space or colors in a color space as linear combinations of CIE XYZ values, such as the linear RGB color space used in definition of the standard color space sRGB and given by the following matrix equation:

$$\begin{bmatrix} R_{linear} \\ G_{linear} \\ B_{linear} \end{bmatrix} = \begin{bmatrix} 3.2406 & -1.5372 & -0.4986 \\ -0.9689 & 1.8758 & 0.0415 \\ 0.0557 & -0.2040 & 1.0570 \end{bmatrix} \begin{bmatrix} X \\ Y \\ Z \end{bmatrix}$$

When the input image color space is sRGB, the plurality of input image colors can be converted into above linear RGB color space after a de-gamma process, which is an inverse of the process converting the linear RGB values to the sRGB values by the definition of the standard sRGB color space.

Figure 10B:
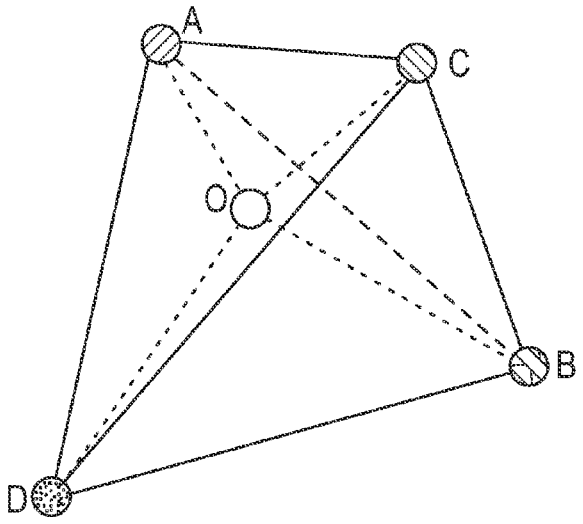
FIG. 10B illustrates an example of representing an input color (O) as a combination of four different primary colors.

FIG. 10B illustrates an example of representing an input color (O) as a combination of four different primary colors. Particularly, a color O within a tetrahedron formed by four primary colors A, B, C and D at its corners can be represented by a linear combination of the four primary colors A, B, C and D.

The weights associated with each of the four primary colors A, B, C and D that when blended together yield an average color equal to the given color O inside the tetrahedron ABCD can be calculated as follows. The point O divides the tetrahedron into four sub-tetrahedrons, OBCD, AOCD, ABOD and ABCO. Then four blending weights are given by Equation (1) below:

$$W_A = V_{OBCD}/V_{ABCD},$$

$$W_B = V_{AOCD}/V_{ABCD},$$

$$W_C = V_{ABOD}/V_{ABCD},$$

$$W_D = V_{ABCO}/V_{ABCD}, \quad (1)$$

In above equations, $V_{ABCD}$ denotes the volume of the tetrahedron ABCD, which is defined by the color coordinates of the four primaries, $(R_A, G_A, B_A)$, $(R_B, G_B, B_B)$, $(R_C, G_C, B_C)$ and $(R_D, G_D, B_D)$. The sum of the four weights above is one, if the color point O is within the tetrahedron ABCD. If the color space used in above calculation is the CIE XYZ color space or the linear RGB color space as a linear transformation of the CIE XYZ color space, the desired color O can be obtained by spatially and/or temporally blending the four primaries with corresponding weights as given by equation 2 below:

$$R_O = w_A*R_A + w_B*R_B + w_C*R_C + w_D*R_D,$$

$$G_O = w_A*G_A + w_B*G_B + w_C*G_C + w_D*G_D,$$

$$B_O = w_A*B_A + w_B*B_B + w_C*B_C + w_D*B_D \quad (2)$$

A color within a tetrahedron defined by four device primary colors can be represented by a linear combination of four device primary colors associated with a multi-primary display device, which may be an IMOD or AIMOD device. Similarly, an input color within a tetrahedron defined by four input primary colors can be also represented by a linear combination of the four input primaries. The primary matched gamut mapping method described herein maps all input colors within a given tetrahedron defined by four input primaries to corresponding colors in another tetrahedron defined by four matched device primaries and the one-to-one mapping is based on the weight distribution calculated for the input colors. If the four device primary colors exactly match the four input primaries, respectively, there is no color distortion for any mapped colors. For other situations, the color distortion will be mostly limited by the color differences between the corresponding matched input and device primaries.

The RGB input colors can be directly mapped to device-dependent RGB output colors using the weight distributions by equation (1). This mapping process is much simpler than most other color mapping methods based on 3-dimensional look-up-tables or more complicated matrix computations. Various spatial and/or temporal dithering methods of rendering the image on the display device also rely on the weights associated with the different device primary colors. Thus, the weight distribution obtained by the mapping process described above can be directly applied to those dithering process and also reduce the computations involved spatial and/or temporal dithering methods.

The color mapping process is further explained by the examples provided below.

Example I

Primary Matched Gamut Mapping with Eight (8) Device Primary Colors

Consider an input image including a plurality of image colors in an image color space. In various implementations, the image color space can be the CIE XYZ color space or the linear RGB color space as a linear transformation of the CIE XYZ color space. The input image can include a plurality of image pixels that can be mapped onto corresponding display elements of a multi-primary display device. At least some of the display elements can include an implementation of an IMOD (e.g., AIMOD 900) and be capable of displaying a plurality of primary colors in a color space associated with the display device. In an implementation of the primary matched gamut mapping, the color gamut of the device can be formed by eight (8) primary colors selected from the display color primaries.

Figure 11A:
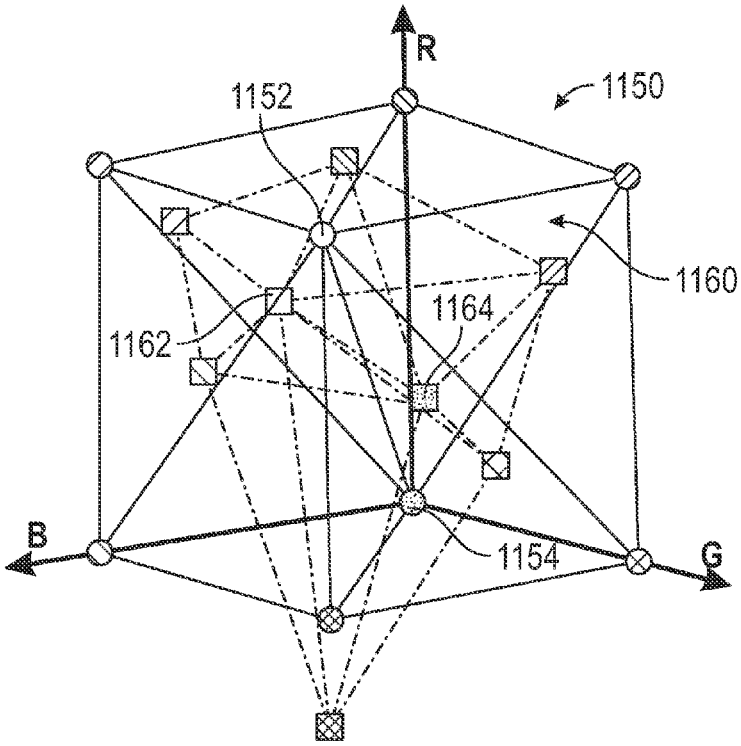
FIG. 11A shows an example of the input color gamut and an example of the display device color gamut.

FIG. 11A shows an example of the color gamut 1150 of the input image colors and an example of the color gamut 1160 of the display colors. The gamut 1150 can be cube shaped, the corners of which are formed by a white (W) image primary color 1152, black (K) image primary color 1154, the three image primary colors red (R), green (G) and blue (B) and their combinations cyan (C), magenta (M) and yellow (Y). The gamut 1160 is a polygon, the corners of which are formed by a white (W) device primary color 1162, black (K) device primary color 1164 and six (6) different non-white and non-black device primary colors.

Figure 11B:
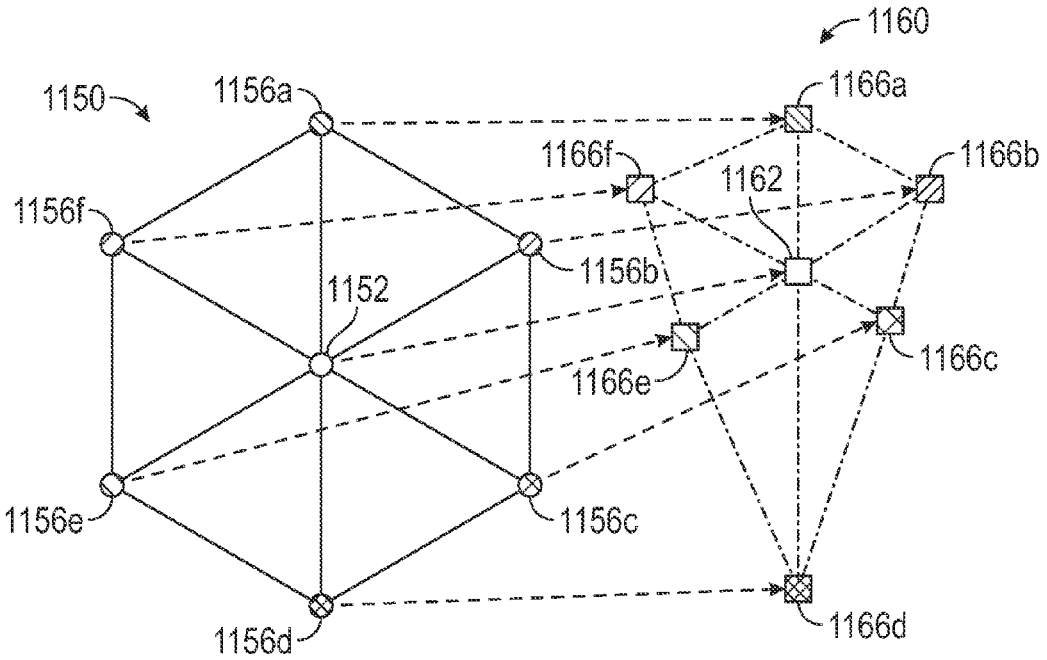
FIG. 11B illustrates a top view of the input color gamut along an axis connecting the white (W) input primary color and black (K) input primary color and a top view of the display device color gamut along an axis connecting the white (W) device primary color and black (K) device primary color.

FIG. 11B illustrates a top view of the gamut 1150 along an axis connecting the white (W) image primary color 1152 and black (K) image primary color 1154 and a top view of the gamut 1160 along an axis connecting the white (W) device primary color 1162 and black (K) device primary color 1164 which are used to explain the color mapping process. In the top view, the gamut 1150 is hexagonally shaped with the white (W) image primary color 1152 and black (K) image primary color 1154 overlapping with each other and disposed at the center of the hexagon and the three image primary colors red (R) 1156*a*, green (G) 1156*e* and blue (B) 1156*c* and their combinations cyan (C) 1156*d*, magenta (M) 1156*b* and yellow (Y) 1156*f* disposed at the corners of the hexagon. The top view of the gamut 1160 is also a six sided polygon with the white (W) device primary color 1162 and black (K) device primary color 1164 overlapping with each other and disposed within the polygon and the six (6) different device primary colors 1166*a*, 1166*b*, 1166*c*, 1166*d*, 1166*e*, and 1166*f* disposed at the corners of the polygon. As noted from FIG. 11A, the white device primary color and the white image primary color do not coincide with each other. Similarly, the black device primary color and the black image primary color do not coincide with each other. Thus, the two top views for the gamut 1150 and gamut 1160 are from different viewing angles.

The six (6) different non-white and non-black device primary colors 1166*a*-1166*f* of the gamut 1160 can be selected such that they are perceptually similar to the three image primary colors red (R) 1156*a*, green (G) 1156*e* and blue (B) 1156*c* and their combinations cyan (C) 1156*d*, magenta (M) 1156*b* and yellow (Y) 1156*f* of the gamut 1150. For example, the device primary color 1166*a* is selected such that it is perceptually similar to the image primary color 1156*a*; the device primary color 1166*b* is selected such that it is perceptually similar to the image primary color 1156*b*; the device primary color 1166*c* is selected such that it is perceptually similar to the image primary color 1156*c* and so on. Without any loss of generality, a non-white and non-black device primary color can be considered to be perceptually similar to a non-white and non-black image color if a color difference between them in a standard color space is less than a threshold. For example, a distance between the non-white and non-black device primary color and the non-white and non-black image color in the CIEXYZ color space can be less than a threshold. As another example, a CIELAB color difference $\Delta E^*$ in the CIE 1976 (L*, a*, b*) color space (CIELAB) between the non-white and non-black device primary color and a non-white and non-black image color given by the $\sqrt{(L_1^*-L_2^*)^2+(a_1^*-a_2^*)^2+(b_1^*-b_2^*)^2}$, where $(L_1, a_1, b_1)$ and $(L_2, a_2, b_2)$ are the coordinates of the non-white and non-black device primary color and the non-white and non-black image color respectively in the CIELAB color space can be less than or equal to a threshold value such that they appear perceptually similar. As yet another example, the color difference between the non-white and non-black device primary color and the non-white and non-black image color can be measured by the color hue difference $\sqrt{(a_1^*-a_2^*)^2+(b_1^*-b_2^*)^2}$, where $(a_1, b_1)$ and $(a_2, b_2)$ are the coordinates of the non-white and non-black device primary color and the non-white and non-black image color respectively in the CIELAB color space. The six different non-white and non-black device primary colors can be selected by minimizing the hue differences, respectively.

To map the input color of an input image pixel to a corresponding display element of the display device includes dividing the gamut 1160 associated with the display device is divided into six tetrahedral segments. Each of the six tetrahedral segments includes the white (W) device primary color 1162, the black (K) device primary color 1164 and two non-white and non-black device primary color selected from the six (6) different non-white and non-black device primary colors 1166*a*-1166*f*, as shown in FIG. 11B.

The gamut 1150 is also similarly divided into six tetrahedral segments such that each of the six tetrahedral segments of the gamut 1160 corresponds with one of the six (6) tetrahedral segments of the gamut 1150. Each of the six tetrahedral segments of the gamut 1150 includes the white (W) image primary color 1152, the black (K) image primary color 1154 and two of the non-white and non-black image color selected from the three image primary colors red (R) 1156*a*, green (G) 1156*e* and blue (B) 1156*c* and their combinations cyan (C) 1156*d*, magenta (M) 1156*b* and yellow (Y) 1156*f*, as shown in FIG. 11B.

The mapping process further includes identifying one of the six tetrahedral segments of the gamut 1150 that includes the input color of the image pixel. Since, the non-white and non-black device primary colors 1166*a*-1166*f* are perceptually similar to the non-white and non-black image color 1156*a*-1156*f*, the input color of the image pixel can be expressed as a linear combination of the white (W) device primary color 1162, the black (K) device primary color 1164 and two of the six non-white and non-black device primary colors 1166*a*-1166*f* of the tetrahedral segment of the gamut 1160 that corresponds to the tetrahedral segment of the gamut 1150 that includes the input color. Once the tetrahedral segment that includes the input color is identified, the four weights for obtaining the same color appearance of the input color by weighted mixing the four input primary colors that correspond to the tetrahedral segment of the input color gamut 1150 can be calculated using equation 1. Then, the input color of the image pixel can be mapped into a device-dependent color by weighted mixing of the four device primary colors that correspond to the tetrahedral segment of the device color gamut using the same weight distribution.

Example II

Primary Matched Gamut Mapping with Greater than Eight (8) Device Primary Colors The above-described gamut mapping method can be extended to include more than eight (8) device primary colors. For example, the device gamut 1160 can include 16 device primary colors including the white (W) device primary color, the black (K) device primary color and fourteen (14) non-white and non-black device primary colors. The fourteen (14) non-white and non-black device primary colors can be located on a spiral curve similar to the spiral curve shown in FIG. 10. Accordingly, the gamut 1160 can be divided into fourteen tetrahedral segments including the white (W) device primary color, the black (K) device primary color and two of the fourteen (14) non-white and non-black device primary colors. In implementations of the display device including an IMOD based display element, the fourteen (14) non-white and non-black device primary colors are selected based on the ability of the display element to stably and reliably achieve the gap height required to display the selected primary color.

Figure 12:
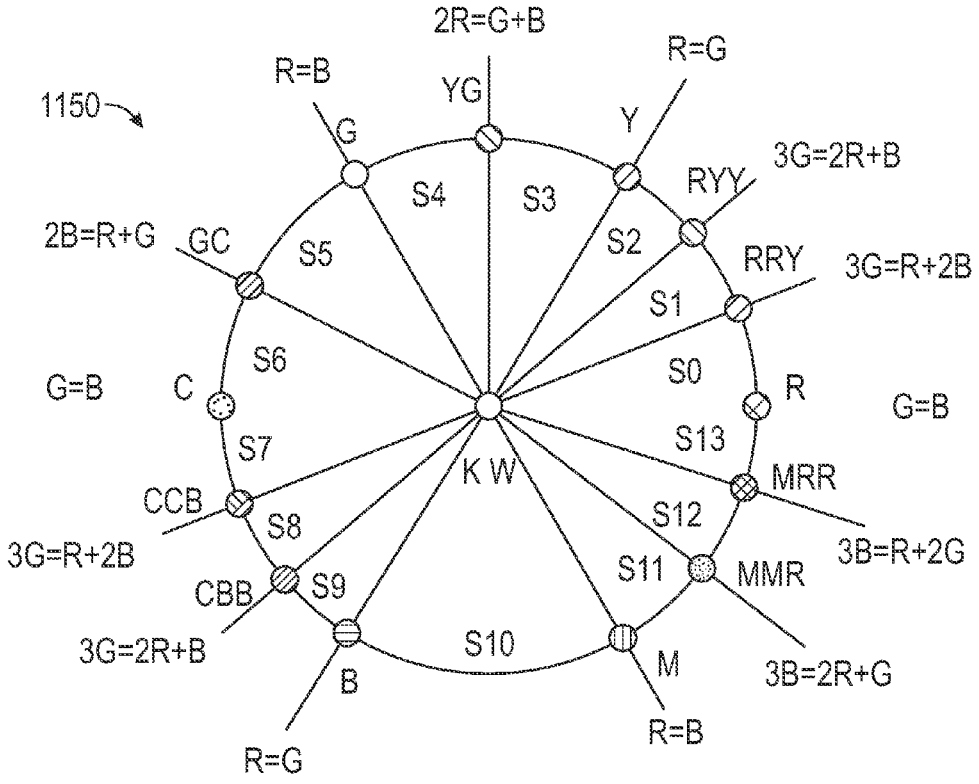
FIG. 12 illustrates an example of the input color gamut divided into fourteen (14) segments S0-S13.

The gamut 1150 is also divided into fourteen (14) corresponding segments. FIG. 12 illustrates an example of the input color gamut divided into fourteen (14) segments S0-S13. Each segment of the gamut 1150 includes a white (W) image primary color, a black (K) image primary color and two non-white and non-black image colors. The two non-white and non-black image colors can be selected from a set including the red (R), green (G) and blue (B) image primary colors and their eleven (11) combinations. The non-white and non-black image colors of the gamut 1150 are selected such that they are perceptually similar to the fourteen (14) non-white and non-black device primary colors.

In the illustrated implementation, the eleven combinations include yellow (Y) which is a combination of equal parts of the red (R) primary color and the green (G) primary color, cyan (C) which is a combination of equal parts of the blue (B) primary color and the green (G) primary color, magenta (M) which is a combination of equal parts of the red (R) primary color and the blue (B) primary color, a color that is a combination of 2 parts of magenta and 1 part of red, a color that is a combination of 2 parts of red and 1 part of magenta, a color that is a combination of 2 parts of yellow and 1 part of red, a color that is a combination of 2 parts of red and 1 part of yellow, a color that is a combination of equal parts of green and yellow, a color that is a combination of equal parts of green and cyan, a color that is a combination of 2 parts of cyan and 1 part of blue, a color that is a combination of 2 parts of blue and 1 part of cyan.

The different segments of the gamut 1150 can have unequal areas (and/or volumes), since it may not be possible for display element to reliably and stably achieve the gap heights that would produce all the colors that are perceptually similar to the color combinations that would equally divide the gamut 1150. For example, the example gamut 1150 illustrated in FIG. 12 does not include a cutting plane that would provide a tetrahedral segment including blue (B) primary color and a color that is a combination of equal parts of magenta (M) and blue (B), since it may be difficult for some implementations of the display element to reliably and stably achieve the gap height that would produce a color perceptually similar to a combination of equal parts of magenta (M) and blue (B).

The color combinations of the segments of the gamut 1150 can be selected differently than shown in FIG. 12. For example, the midpoint between 2 adjacent colors need not be used in some implementations. Further, the example shown in FIG. 12 can be generalized to a display device having N-2 non-white and non-black primaries (where N can be 4, 6, 8, 12, 16, 18, 24, 32, or a different number). For example, the two non-white and non-black image colors of a segment of the gamut can be selected from a set including the red (R), green (G) and blue (B) image primary colors and their N-5 combinations (with various weightings). The non-white and non-black image colors of the gamut can be selected such that they are perceptually similar to the N-2 non-white and non-black device primary colors.

The color mapping methods described herein can be advantageous in rendering images including colors in saturated sRGB primary colors. Since the eight saturated sRGB primaries, white (W) image, black (K), red (R), green (G), blue (B), cyan (C), magenta (M) and yellow (Y), are all mapped to corresponding device primary colors, W, K, R, G, B, C, M and Y, by the described mapping methods, no further color mixing or dithering is needed for the display. Accordingly, the display outputs appear smoother and have less color shift when the viewing angle changes.

Further, certain implementations of the functionality of the present disclosure are sufficiently mathematically, computationally, or technically complex that application-specific hardware or one or more physical computing devices (utilizing appropriate executable instructions) may be necessary to perform the functionality, for example, due to the volume or complexity of the calculations involved or to provide results substantially in real-time. For example, in some implementations using a large number of primary colors (e.g., greater than 8 primary colors) and several temporal frames (e.g., greater than 3), the number of possible color combinations can be very large (e.g., hundreds, thousands, or more possible colors) and a physical computing device may be necessary to select the appropriate combinations of primary colors to be displayed from the large number of possible colors. Accordingly, various implementations of the methods described herein can be performed by a hardware processor included in the display device (for example, the processor 21, the driver controller 29, and/or the array driver 22 described below with reference to the display device of FIGS. 14A and 14B). To perform the methods described herein, the processor can execute a set of instructions stored in non-transitory computer storage. The processor can access a computer-readable medium that stores the indices for the primary colors and/or the last input image. A look-up table (LUT) can be used to store the weight distribution that establishes a correspondence between the display color and the set of primary colors. Various other implementations of the methods described herein can be performed by a hardware processor included in a computing device separate from the display device. In such implementations, the outputs of the methods can be stored in non-transitory computer storage and provided for use in a display device.

Figure 13:
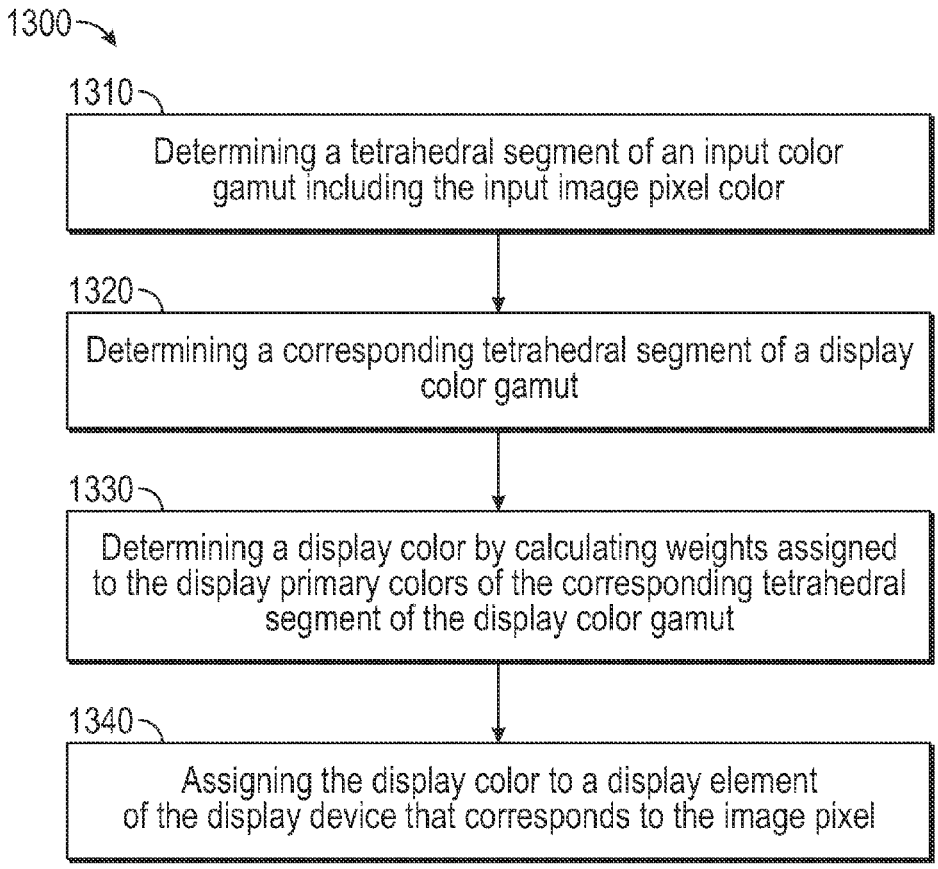
FIG. 13 is a flowchart that illustrates an example of a color mapping method that can be used to display an input image including a plurality of image pixels on a display device having a plurality of display elements.

FIG. 13 is a flowchart that illustrates an example of a color mapping method 1300 that can be used to display an input image including a plurality of image pixels on a display device having a plurality of display elements. Each display element can be configured to display a plurality of colors in a display color gamut associated with the display device. In various implementations, the display element can be similar to the AIMOD 900 discussed above. Each of the plurality of image pixels can be associated with a color in an input color gamut. As used herein, a color associated with each of the plurality of image pixels can include at least one of tone, grayscale, hue, chroma, saturation, brightness, lightness, luminance, correlated color temperature, dominant wavelength and/or a coordinate in a color space. In various implementations, the color associated with each of the plurality of image pixels can have a value between 0 and 255.

The input color gamut includes the colors of the input image. The input color gamut can be divided into a plurality of tetrahedral segments. Each of the plurality of tetrahedral segments of the input color gamut includes a first set of image colors including a white image primary color, a black image primary color and two non-white and non-black image colors. The two non-white and non-black image colors can be selected from the primary colors of the color space and their combinations.

The display element is associated with a display color gamut including all the colors that can be displayed by the display element. Each tetrahedral segment of the input color gamut has a corresponding tetrahedral segment in the display color gamut. Accordingly, the display color gamut is also divided into a plurality of tetrahedral segments. Each of the plurality of tetrahedral segments of the display color gamut includes a second set of display colors including a white device primary color, a black device primary color and two non-white and non-black device primary colors selected from a plurality of device primary colors that can be displayed by the display element.

Each of the non-white and non-black device primary color of a tetrahedral segment of the display color gamut is perceptually similar to a corresponding non-white and non-black image color of a corresponding tetrahedral segment of the input color gamut.

The method 1300 includes determining a tetrahedral segment of the input color gamut including the input image pixel color, as shown in block 1310. The method 1300 further includes determining a corresponding tetrahedral segment of the display color gamut, as shown in block 1320. The method 1300 further includes determining a display color by calculating weights to be assigned to the second set of device primary colors of the corresponding tetrahedral segment of the display color gamut, as shown in block 1330. In various implementations, calculating weights to be assigned can include calculating the twelve (12) coefficients of the m-matrix in Equation (2) above.

For implementations of IMOD based display elements, the plurality of device primary colors can be represented a linear combination of colors in the CIEXYZ color space. Accordingly, for such implementations of IMOD based display elements, the display color is a weighted linear combination of the primary colors included in the second set of device primary colors.

The method 1300 further includes assigning the determined display color to a display element of the display device that corresponds to the image pixel, as shown in block 1340. In various implementations, the method can include spatially and/or temporally dithering the primary colors included in the second set of device primary colors in accordance with the calculated weights.

The method 1300 can be performed in its entirety by a physical computing device. The computing device can include a hardware processor and one or more buffers. A non-transitory computer readable storage medium can include instructions that can be executed by a processor in a physical computing device to perform the method 1300. In various implementations, the computing device and/or the non-transitory computer readable storage medium can be included with a system that includes a display device including a plurality of IMOD display elements including but not limited to implementations similar to AIMOD 900.

Figure 14A:
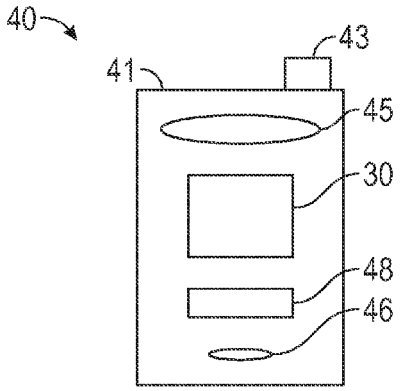
FIGS. 14A and 14B are system block diagrams illustrating a display device that includes a plurality of IMOD display elements.
Figure 14B:
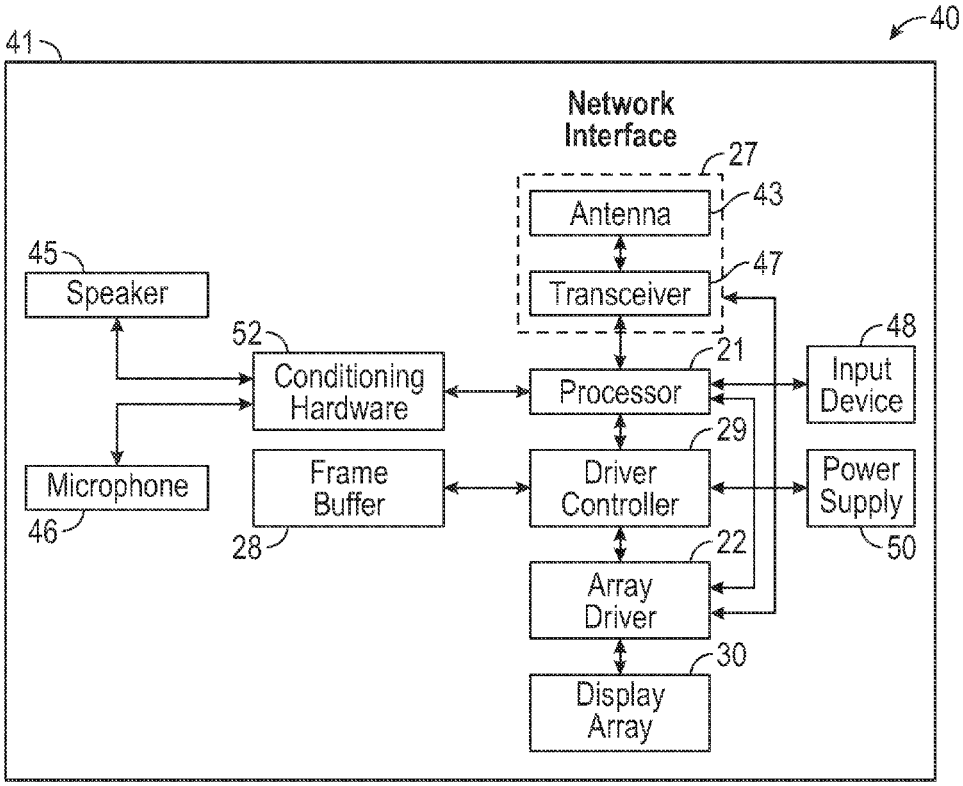

FIGS. 14A and 14B are system block diagrams illustrating a display device 40 that includes a plurality of IMOD display elements including but not limited to implementations similar to AIMOD 900. The display device 40 can be configured to use temporal (and/or spatial) modulations schemes that utilize the constrained color palette disclosed herein. The display device 40 can be, for example, a smart phone, a cellular or mobile telephone. However, the same components of the display device 40 or slight variations thereof are also illustrative of various types of display devices such as televisions, computers, tablets, e-readers, hand-held devices and portable media devices.

The display device 40 includes a housing 41, a display 30, an antenna 43, a speaker 45, an input device 48 and a microphone 46. The housing 41 can be formed from any of a variety of manufacturing processes, including injection molding, and vacuum forming. In addition, the housing 41 may be made from any of a variety of materials, including, but not limited to: plastic, metal, glass, rubber and ceramic, or a combination thereof. The housing 41 can include removable portions (not shown) that may be interchanged with other removable portions of different color, or containing different logos, pictures, or symbols.

The display 30 may be any of a variety of displays, including a bi-stable or analog display, as described herein. The display 30 also can be configured to include a flat-panel display, such as plasma, EL, OLED, STN LCD, or TFT LCD, or a non-flat-panel display, such as a CRT or other tube device. In addition, the display 30 can include an IMOD-based display, as described herein.

The components of the display device 40 are schematically illustrated in FIG. 14A. The display device 40 includes a housing 41 and can include additional components at least partially enclosed therein. For example, the display device 40 includes a network interface 27 that includes an antenna 43 which can be coupled to a transceiver 47. The network interface 27 may be a source for image data that could be displayed on the display device 40. Accordingly, the network interface 27 is one example of an image source module, but the processor 21 and the input device 48 also may serve as an image source module. The transceiver 47 is connected to a processor 21, which is connected to conditioning hardware 52. The conditioning hardware 52 may be configured to condition a signal (such as filter or otherwise manipulate a signal). The conditioning hardware 52 can be connected to a speaker 45 and a microphone 46. The processor 21 also can be connected to an input device 48 and a driver controller 29. The driver controller 29 can be coupled to a frame buffer 28, and to an array driver 22, which in turn can be coupled to a display array 30. One or more elements in the display device 40, including elements not specifically depicted in FIG. 16A, can be configured to function as a memory device and be configured to communicate with the processor 21. In some implementations, a power supply 50 can provide power to substantially all components in the particular display device 40 design.

The network interface 27 includes the antenna 43 and the transceiver 47 so that the display device 40 can communicate with one or more devices over a network. The network interface 27 also may have some processing capabilities to relieve, for example, data processing requirements of the processor 21. The antenna 43 can transmit and receive signals. In some implementations, the antenna 43 transmits and receives RF signals according to the IEEE 16.11 standard, including IEEE 16.11(a), (b), or (g), or the IEEE 802.11 standard, including IEEE 802.11a, b, g, n, and further implementations thereof. In some other implementations, the antenna 43 transmits and receives RF signals according to the Bluetooth® standard. In the case of a cellular telephone, the antenna 43 can be designed to receive code division multiple access (CDMA), frequency division multiple access (FDMA), time division multiple access (TDMA), Global System for Mobile communications (GSM), GSM/General Packet Radio Service (GPRS), Enhanced Data GSM Environment (EDGE), Terrestrial Trunked Radio (TETRA), Wideband-CDMA (W-CDMA), Evolution Data Optimized (EV-DO), NEV-DO, EV-DO Rev A, EV-DO Rev B, High Speed Packet Access (HSPA), High Speed Downlink Packet Access (HSDPA), High Speed Uplink Packet Access (HSUPA), Evolved High Speed Packet Access (HSPA+), Long Term Evolution (LTE), AMPS, or other known signals that are used to communicate within a wireless network, such as a system utilizing 3G, 4G or 5G technology. The transceiver 47 can pre-process the signals received from the antenna 43 so that they may be received by and further manipulated by the processor 21. The transceiver 47 also can process signals received from the processor 21 so that they may be transmitted from the display device 40 via the antenna 43.

In some implementations, the transceiver 47 can be replaced by a receiver. In addition, in some implementations, the network interface 27 can be replaced by an image source, which can store or generate image data to be sent to the processor 21. The processor 21 can control the overall operation of the display device 40. The processor 21 receives data, such as compressed image data from the network interface 27 or an image source, and processes the data into raw image data or into a format that can be readily processed into raw image data. The processor 21 can send the processed data to the driver controller 29 or to the frame buffer 28 for storage. Raw data typically refers to the information that identifies the image characteristics at each location within an image. For example, such image characteristics can include color, saturation and gray-scale level. The processor 21 (or other computing hardware in the device 40) can be programmed to perform implementations of the methods described herein such as the methods 1000 and 1300. The processor 21 (or other computing hardware in the device 40) can be in communication with a computer-readable medium that includes instructions, that when executed by the processor 21, cause the processor 21 to perform implementations of the methods described herein such as the methods 1000 and 1300.

The processor 21 can include a microcontroller, CPU, or logic unit to control operation of the display device 40. The conditioning hardware 52 may include amplifiers and filters for transmitting signals to the speaker 45, and for receiving signals from the microphone 46. The conditioning hardware 52 may be discrete components within the display device 40, or may be incorporated within the processor 21 or other components.

The driver controller 29 can take the raw image data generated by the processor 21 either directly from the processor 21 or from the frame buffer 28 and can re-format the raw image data appropriately for high speed transmission to the array driver 22. In some implementations, the driver controller 29 can re-format the raw image data into a data flow having a raster-like format, such that it has a time order suitable for scanning across the display array 30. Then the driver controller 29 sends the formatted information to the array driver 22. Although a driver controller 29, such as an LCD controller, is often associated with the system processor 21 as a stand-alone Integrated Circuit (IC), such controllers may be implemented in many ways. For example, controllers may be embedded in the processor 21 as hardware, embedded in the processor 21 as software, or fully integrated in hardware with the array driver 22.

The array driver 22 can receive the formatted information from the driver controller 29 and can re-format the video data into a parallel set of waveforms that are applied many times per second to the hundreds, and sometimes thousands (or more), of leads coming from the display's x-y matrix of display elements.

In some implementations, the driver controller 29, the array driver 22, and the display array 30 are appropriate for any of the types of displays described herein. For example, the driver controller 29 can be a conventional display controller or a bi-stable display controller (such as an IMOD display element controller). Additionally, the array driver 22 can be a conventional driver or a bi-stable display driver (such as an IMOD display element driver). Moreover, the display array 30 can be a conventional display array or a bi-stable display array (such as a display including an array of IMOD display elements). The driver controller 29 and/or the array driver 22 can be an AIMOD controller or driver. In some implementations, the driver controller 29 can be integrated with the array driver 22. Such an implementation can be useful in highly integrated systems, for example, mobile phones, portable-electronic devices, watches or small-area displays.

In some implementations, the input device 48 can be configured to allow, for example, a user to control the operation of the display device 40. The input device 48 can include a keypad, such as a QWERTY keyboard or a telephone keypad, a button, a switch, a rocker, a touch-sensitive screen, a touch-sensitive screen integrated with the display array 30, or a pressure- or heat-sensitive membrane. The microphone 46 can be configured as an input device for the display device 40. In some implementations, voice commands through the microphone 46 can be used for controlling operations of the display device 40.

The power supply 50 can include a variety of energy storage devices. For example, the power supply 50 can be a rechargeable battery, such as a nickel-cadmium battery or a lithium-ion battery. In implementations using a rechargeable battery, the rechargeable battery may be chargeable using power coming from, for example, a wall socket or a photovoltaic device or array. Alternatively, the rechargeable battery can be wirelessly chargeable. The power supply 50 also can be a renewable energy source, a capacitor, or a solar cell, including a plastic solar cell or solar-cell paint. The power supply 50 also can be configured to receive power from a wall outlet.

In some implementations, control programmability resides in the driver controller 29 which can be located in several places in the electronic display system. In some other implementations, control programmability resides in the array driver 22. The above-described methods for generating a constrained color palette may be implemented in any number of hardware and/or software components and in various configurations.

As used herein, a phrase referring to "at least one of" a list of items refers to any combination of those items, including single members. As an example, "at least one of: a, b, or c" is intended to cover: a, b, c, a-b, a-c, b-c, and a-b-c.

The various illustrative logics, logical blocks, modules, circuits and algorithm steps described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and steps described above. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some implementations, particular steps and methods may be performed by circuitry that is specific to a given function.

In one or more aspects, the functions described may be implemented in hardware, digital electronic circuitry, computer software, firmware, including the structures disclosed in this specification and their structural equivalents thereof, or in any combination thereof. Implementations of the subject matter described in this specification also can be implemented as one or more computer programs, i.e., one or more modules of computer program instructions, encoded on a computer storage media for execution by, or to control the operation of, data processing apparatus.

If implemented in software, the functions may be stored on or transmitted over as one or more instructions or code on a computer-readable medium. The steps of a method or algorithm disclosed herein may be implemented in a processor-executable software module which may reside on a computer-readable medium. Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above also may be included within the scope of computer-readable media. Additionally, the operations of a method or algorithm may reside as one or any combination or set of codes and instructions on a machine readable medium and computer-readable medium, which may be incorporated into a computer program product.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of, e.g., an IMOD display element as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, a person having ordinary skill in the art will readily recognize that such operations need not be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. An apparatus comprising: a display device including a reflective display element capable of displaying N device primary colors associated with a display color gamut divided into N-2 segments, Wherein a number of the N primary colors is greater than or equal to six; and a computing device capable of communicating with the display device, the computing device capable of processing image data including a plurality of image pixels with each image pixel associated with an input image pixel color represented as a combination of different input primary colors associated with an input color gamut divided into N-2 segments, each of the N-2 segments of the display color gamut corresponding to one of the N-2 segments of the input color gamut, wherein the computing device is further capable of for a given image pixel: determining a tetrahedral segment of the input color gamut that includes the input image pixel color, the tetrahedral segment including a first set of image colors; determining a corresponding tetrahedral segment of the display color gamut, the display color gamut tetrahedral segment including a second set of device primary colors selected from the N device primary colors, wherein at least two image colors of the first set are perceptually similar to two corresponding device primary colors of the second set;

calculating weights for a linear combination of the first set of image color such that the input image pixel color is a weighted combination of the first set of image colors; determining a display color by applying the calculated weights to the second set of device primary colors, the display color being a weighted combination of the second set of device primary colors; and assigning the display color to a display element of the display device that corresponds to the image pixel.

2. The apparatus of claim 1, wherein the first set of image colors includes a black input primary color, a white input primary color, a first non-white and non-black color, and a second non-white and non-black color, and wherein the first and second non-white and non-black colors are a combination of one or more input primary colors.

3. The apparatus of claim 2, wherein the second set of device primary colors includes a black device primary color, a white device primary color, a first non-white and non-black device primary color and a second non-white and non-black device primary color, the first and second non-white and non-black device primary colors selected from the N device primary colors.

4. The apparatus of claim 3, wherein the first non-white and non-black device primary color is perceptually similar to the first non-white and non-black color of the corresponding tetrahedral segment of the input color gamut, and wherein the second non-white and non-black device primary color is perceptually similar to the second non-white and non-black color of the corresponding tetrahedral segment of the input color gamut.

5. The apparatus of claim 1, wherein the display device is a reflective display device.

6. The apparatus of claim 1, wherein the reflective display element includes a movable mirror.

7. The apparatus of claim 6, wherein each of the N primary colors corresponds to a distinct position of the movable mirror.

8. The apparatus of claim 1, further comprising a driver circuit capable of sending at least one signal to the display device.

9. The apparatus of claim 8, further comprising a controller capable of sending at least a portion of the image data to the driver circuit.

10. The apparatus of claim 1, further comprising an image source module capable of sending the image data to the processor.

11. The apparatus of claim 10, wherein the image source module includes at least one of a receiver, transceiver, and transmitter.

12. The apparatus of claim 1, further comprising an input device capable of receiving input data and to communicate the input data to the processor.

13. The display device of claim 1, wherein the number of the N primary colors is less than 256.

14. The display device of claim 1, wherein a number of segments of the display color gamut is at least four.

15. A computer-implemented method to display image data on a display device including a reflective display element capable of displaying N device primary colors associated with a display color gamut divided into N-2 segments, wherein a number of the N primary colors is greater than or equal to six, the image data including a plurality of image pixels with each image pixel associated with an input image pixel color represented as a combination of different input primary colors associated with an input color gamut divided into N-2 segments, each of the N-2 segments of the display color gamut corresponding to one of the N-2 segments of the input color gamut, the method comprising: under control of a hardware computing device associated with the display device: for a given image pixel: determining a tetrahedral segment of the input color gamut that includes the input image pixel color, the tetrahedral segment including a first set of image colors; determining a corresponding tetrahedral segment of the display color gamut, the display color gamut tetrahedral segment including a second set of device primary colors selected from the N device primary colors, wherein at least two image colors of the first set are perceptually similar to two corresponding device primary colors of the second set; calculating weights for a linear combination of the first set of image color such that the input image pixel color is a weighted combination of the first set of image colors; determining a display color by applying the calculated weights to the second set of device primary colors, the display color being a weighted combination of the second set of device primary colors; and assigning the display color to a display element of the display device that corresponds to the image pixel.

16. The method of claim 15, wherein a number of segments of the display color gamut is at least four.

17. A non-transitory computer storage medium comprising instructions that when executed by a processor cause the processor to perform a method to display image data on a display device including a reflective display element capable of displaying N device primary colors associated with a display color gamut divided into N-2 segments, wherein a number of the N primary colors is greater than or equal to six; the image data including a plurality of image pixels with each image pixel associated with an input image pixel color represented as a combination of different input primary colors associated with an input color gamut divided into N-2 segments, each of the N-2 segments of the display color gamut corresponding to one of the N-2 segments of the input color gamut; the method comprising: under control of a hardware computing device associated with the display device: for a given image pixel: determining a tetrahedral segment of the input color gamut that includes the input image pixel color, the tetrahedral segment including a first set of image colors; determining a corresponding tetrahedral segment of the display color gamut, the display color gamut tetrahedral segment including a second set of device primary colors selected from the N device primary colors, wherein at least two image colors of the first set are perceptually similar to two corresponding device primary colors of the second set; calculating weights for a linear combination of the first set of image color such that the input image pixel color is a weighted combination of the first set of image colors; determining a display color by applying the calculated weights to the second set of device primary colors; the display color being a weighted combination of the second set of device primary colors; and assigning the display color to a display element of the display device that corresponds to the image pixel.

18. The medium of claim 17, wherein a number of segments of the display color gamut is greater than or equal to four.

* * * * *